US009749769B2

(12) United States Patent
Giron

(10) Patent No.: US 9,749,769 B2
(45) Date of Patent: Aug. 29, 2017

(54) METHOD, DEVICE AND SYSTEM

(71) Applicant: Sony Corporation, Tokyo (JP)

(72) Inventor: Franck Giron, Waiblingen (DE)

(73) Assignee: SONY CORPORATION, Tokyo (JP)

( * ) Notice: Subject to any disclaimer, the term of this patent is extended or adjusted under 35 U.S.C. 154(b) by 147 days.

(21) Appl. No.: 14/798,909

(22) Filed: Jul. 14, 2015

(65) Prior Publication Data

US 2016/0037282 A1 Feb. 4, 2016

(30) Foreign Application Priority Data

Jul. 30, 2014 (EP) ..... 14179152

(51) Int. Cl.

| | |
|---|---|
| ***H04R 5/02*** | (2006.01) |
| ***H04S 7/00*** | (2006.01) |
| *H04R 1/30* | (2006.01) |
| *H04R 1/34* | (2006.01) |
| *H04R 1/40* | (2006.01) |

(52) U.S. Cl.

CPC ..... *H04S 7/30* (2013.01); *H04R 1/30* (2013.01); *H04R 1/345* (2013.01); *H04R 1/403* (2013.01); *H04R 5/02* (2013.01); *H04R 2201/401* (2013.01); *H04S 2400/11* (2013.01); *H04S 2400/15* (2013.01); *H04S 2420/01* (2013.01); *H04S 2420/13* (2013.01)

(58) Field of Classification Search

CPC .... H04S 2420/01; H04S 7/30; H04S 2400/11; H04S 2400/15; H04S 2420/13; H04R 5/02; H04R 1/403; H04R 1/30; H04R 2201/401; H04R 1/345

See application file for complete search history.

(56) References Cited

U.S. PATENT DOCUMENTS

| | | | | |
|---|---|---|---|---|
| 5,862,227 | A | 1/1999 | Orduna-Bustamante et al. | |
| 8,391,500 | B2 | 3/2013 | Hannemann et al. | |
| 2010/0296678 | A1* | 11/2010 | Kuhn-Rahloff ..... | H04S 7/30 381/303 |
| 2011/0261973 | A1* | 10/2011 | Nelson ..... | H04S 3/00 381/92 |
| 2013/0223658 | A1 | 8/2013 | Betlehem et al. | |

(Continued)

FOREIGN PATENT DOCUMENTS

| | | |
|---|---|---|
| CN | 101843114 A | 9/2010 |
| CN | 101843114 AB | 9/2010 |
| CN | 102790931 A | 11/2012 |

(Continued)

OTHER PUBLICATIONS

Terence Betlehem et al. "Theory and design of sound field reproduction in reverberant rooms", J. Acoust Soc. Am, 117, No. 4, 2005, 12 pages.

(Continued)

*Primary Examiner* — Muhammad N Edun

(74) *Attorney, Agent, or Firm* — Oblon, McClelland, Maier & Neustadt, L.L.P.

(57) ABSTRACT

Method for approximating the synthesis of a target sound field based on contributions of a predefined number of synthesis monopoles placed at respective synthesis positions, the method comprising modelling the target sound field as at least one target monopole placed at a defined target position.

20 Claims, 16 Drawing Sheets

(56) References Cited

U.S. PATENT DOCUMENTS

2014/0098966 A1* 4/2014 Corteel ..... H04S 7/301
381/59

FOREIGN PATENT DOCUMENTS

| | | | |
|---|---|---|---|
| CN | 103650540 | A | 3/2014 |
| JP | 11-252698 | A | 9/1999 |
| WO | WO 94/24835 | A1 | 10/1994 |
| WO | WO 97/30566 | A1 | 8/1997 |

OTHER PUBLICATIONS

Ole Kirkeby et al "Reproduction of plane wave sounds fields", J. Acoust Soc. Am, 94, No. 5, 1993, 9 pages.
Ole Kirkeby et al. "Local sound field reproduction using digital signal processing", J. Acoust Soc. Am, 100, No. 3, 1996, 10 pages.
Sascha Spors et al. "Sound Field Synthesis", In Audio Signal Processing for Next-Generation Multimedia Communication Systems, 2004, 23 pages.
Philip M. Morse et al. "Theoretical Acoustics", Princeton University PressMorse, 1986, 1 page.
William H. Flannery et al. "Numerical Recipes in C", The art of Scientific Computing, 2$^{nd}$ Edition, 1992, 1 page.
Milton Abramowitz et al. "Handbook of Mathematical Functions", Bassel Functions of Fractional Order, 9$^{th}$ Edition, Dover Publications, 1970, 1 page.
Richard G. Lyons et al "Understanding Digital Signal Processing", The Discrete Fourier Transform, 1997, 1 page.
Combined Chinese Office Action and Search Report issued on Dec. 7, 2016 in Patent Application No. 201510461341.3 (with English translation of Categories of Cited Documents).

* cited by examiner

METHOD, DEVICE AND SYSTEM

TECHNICAL FIELD

The present disclosure generally pertains to methods, devices and systems for the generation of spatial sound fields.

TECHNICAL BACKGROUND

Current systems for the generation of a spatial sound field, like Wavefield synthesis, require a relatively large number of acoustic enclosures, mostly available in the form of a set of loudspeakers. The equations used for the derivation of these systems are funded on the wish to reproduce the sound field as exactly as possible.

Current examples are the so called 5.1 or 7.1 systems, which are composed of 5 or 7 loudspeaker enclosures and one or two extra subwoofer, which are designed to reproduce the low frequency range of sound with a higher energy. The main drawback of these systems is the so-called limited sweet spot, where the listener has to be placed in a relatively centered area to enjoy the listening experience.

To cope with this problem, other systems try to recreate the sound field physically in the same way, as if the real sound source would be present. The most well-known system is the so-called Wavefield synthesis. Here the reproduction of a sound field is based on the Huygens principle and approximates it with a number of acoustic enclosures. The main problem of this method is its relative high computational complexity.

SUMMARY

According to a first aspect it is disclosed a method for approximating the synthesis of a target sound field based on contributions of a predefined number of synthesis monopoles placed at respective synthesis positions, the method comprising modeling the target sound field as at least one target monopole placed at a defined target position.

According to a further aspect it is disclosed a device comprising a processor configured to receive a target source signal which corresponds to a target monopole placed at a target position, and determine, based on the target source signal, contributions of a predefined number of synthesis monopoles placed at respective synthesis positions, the synthesis monopoles being configured to synthesize the target source signal.

According to yet a further aspect it is disclosed a system comprising a processor configured to receive a target source signal which corresponds to a target monopole placed at a target position, and determine, based on the target source signal, contributions of a predefined number of synthesis monopoles placed at respective synthesis positions, the synthesis monopoles being configured to synthesize the target source signal, the system further comprising a set of loudspeakers, each loudspeaker being associated with a respective synthesis monopole and being configured to render the contribution which is associated with the respective synthesis monopole.

Further aspects are set forth in the dependent claims, the following description and the drawings.

BRIEF DESCRIPTION OF THE DRAWINGS

Embodiments are explained by way of example with respect to the accompanying drawings, in which.

DETAILED DESCRIPTION OF EMBODIMENTS

Figure 1:
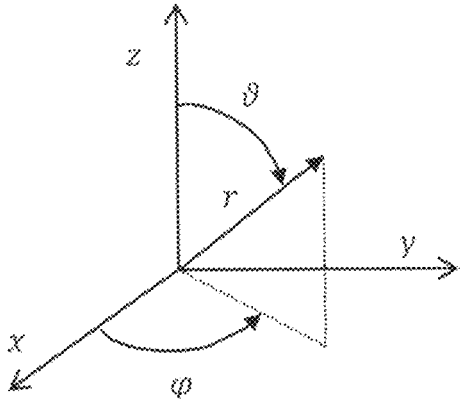
FIG. 1 shows spherical polar coordinates of a point in a Cartesian coordinate system.

Methods are disclosed for approximating the synthesis of a target sound field based on contributions of a predefined number of synthesis monopoles placed at respective synthesis positions, the method comprising modeling the target sound field as at least one target monopole placed at a defined target position.

In general, a target sound field can describe the sound produced by any arbitrary combination of sound sources. A sound field may for example be described by a pressure field in terms of location and time. Alternatively, after Fourier transformation in the time domain, a sound field may for example be described by a pressure field in terms of location and frequency.

In some embodiments described below, the target sound field corresponds to the sound field which is to be reproduced by a loudspeaker system for presenting the target sound field to a listener. The listener may for example be located in a home environment, in a cinema, or in a car. The target sound field may for example be defined by the sound field generated by a group of musicians such as a music ensemble, an orchestra, a pop music band, one or more vocalists, or the like. The target sound field may also be defined by the sound, music and/or voices accompanying a movie scene, or the like. The target sound field may also be defined by a computer, a computer game, a gaming console, a tablet PC, a mobile phone, or the like.

According to the embodiments described below, a target sound field is modelled as at least one target monopole placed at a defined target position. In one embodiment, the target sound field is modelled as one single target monopole. In other embodiments, the target sound field is modelled as multiple target monopoles placed at respective defined target positions. For example, each target monopole may represent a musical instrument comprised in a music ensemble and positioned at a specific location within a room, a concert hall, or the like. A further target monopole may represent sound produced by an audience of a music ensemble, such as the sound of clapping hands. Alternatively, a target monopole may represent the voice of an actor in a movie or the voice of a newsreader.

In yet alternative embodiments, the position of a target monopole may be moving. For example a target monopole may represent an airplane which is a sound source moving above the listener.

If multiple target monopoles are used to represent a target sound field, then the methods of synthesizing the sound of a target monopole based on a set of defined synthesis monopoles as described below may be applied for each target monopole independently, and the contributions of the synthesis monopoles obtained for each target monopole may be summed to reconstruct the target sound field.

In the embodiments described below, the determination of the contributions of the synthesis monopoles is based on calculations which have been obtained by applying a least square approach. In the embodiments, the calculations may be represented by formulas which have been obtained by applying a least square approach. In these embodiments, the formulas reflect the result of the least square approach in the sense that they minimize the error made when approximating the sound field of a target monopole by contributions of a predefined number of synthesis monopoles. As the embodiments are based on reconsidering the generation of the sound field in a least square sense, the corresponding equations may lead to an approximation, which becomes simpler to be used in conjunction with any kind of locations, as opposed to some of the previously known technologies.

The technique which is implemented in the embodiments may be conceptually similar to the Wavefield synthesis, which uses a restricted number of acoustic enclosures to generate a defined sound field. The fundamental basis of the generation principle of the embodiments is, however, specific, since the synthesis doesn't try to model the sound field exactly but is based on a least square approach.

In the embodiments described below, the predefined number of synthesis monopoles corresponds to the number of loudspeakers used in a sound system to render the target sound field. In this case each synthesis monopole is associated with a respective loudspeaker. The number of synthesis monopoles may be fixed or varying. For example, depending on the circumstances specific loudspeakers (for example rear speakers, ceiling reflection actuators, or the like) and associated synthesis monopoles may be excluded from the synthesis.

The method for the generation of the target sound field as disclosed in the embodiments may be based on the combination of a restricted number of loudspeakers, which are modeled in their simplest acoustic form, namely monopole sources.

The disclosed methods may be applied to the generation of a target sound field created by a source placed at a certain location. A limited number of enclosures may be used to recreate the sound field generated by this sound source. Each of these enclosures may be modelled as a simple source, a monopole. Consequently, the sound field may be synthesized by a set of monopoles.

In embodiments in which a loudspeaker enclosure comprises several actuators, for example one actuator which corresponds to a standard left front speaker and one additional actuator of the horn type for causing ceiling reflections, each actuator in the loudspeaker enclosure may be represented by an independent synthesis monopole.

The synthesis positions associated with the synthesis monopoles may represent the locations at which the loudspeakers (or actuators) associated with the synthesis monopoles are actually located in a room. For example the synthesis position of a synthesis monopole which is associated with a left front loudspeaker may correspond to a position to the left of a television device, the synthesis position of a synthesis monopole which is associated with a right front loudspeaker may correspond to a position to the right of a television device, and the synthesis position of a synthesis monopole which is associated with a centre speaker may correspond to a position below or in a television device.

According to the methods described in the embodiments below, for each synthesis monopole a contribution is determined which represents the contribution of the synthesis monopole to the synthesis of the sound field of the target monopole.

The contribution of a synthesis monopole may be calculated based on an input signal which is defined by the sound field of the target monopole to be generated in the synthesis.

The methods as disclosed here may be carried out in a processing device associated with a sound rendering system.

In some of the embodiments described below in more detail, the contribution of a synthesis monopole is dependent on the relative distance between the synthesis monopole and the target monopole. This relative distance may represent the relative distance between a loudspeaker (or actuator) associated with the synthesis monopole and the target source.

According to some embodiments the contribution of a synthesis monopole is determined based on equation $$S_p(\omega) = -i\rho c\frac{\sin kR_{p0}}{R_{p0}}$$

where $S_p(\omega)$ is the pressure transfer function of synthesis monopole indexed p in terms of angular velocity ω, k is the wave number corresponding to angular frequency ω, $R_{p0}=|r_o-r_p|$ is the distance between the target monopole at target position $r_o$ and the synthesis monopole indexed p at position $r_p$, ρ represents the mean density of air, and c represents the celerity of sound in air.

Angular velocity ω represents the frequency with which a sound wave is oscillating. The parameters ρ and c may be chosen according to the specific needs. For example, they may correspond to the mean density of air and the celerity of sound in air at room temperature 20° C.

In other embodiments, a numerical implementation is applied in which a discretization of the time is carried out. Such discretization is also known to the skilled person as 'sampling'.

Approximating the synthesis of a target sound field on the basis of the approximations disclosed here may allow a real-time implementation.

After discretization, the contribution $s_p(n)$ of a synthesis monopole indexed p may for example be determined according to equation $$s_p(n) = \frac{\rho c}{R_{p0}} \cdot \frac{\sin \pi n_p}{M} \cdot \left[ \frac{1}{\tan\left[\frac{\pi(n_p - n)}{M}\right]} + i \right]$$

where T is the sampling period, $n_p = t_p/T$, $R_{p0} = |r_o - r_p|$ is the distance between the target monopole at target position $r_o$ and a synthesis monopole indexed p at position $r_p$, $t_p$ is the sound propagation delay for distance $R_{p0}$, M is the number of samples used for the digital filter, n is a sample number, ρ represents a mean density of air, and c represents the celerity of sound in air. The contribution $s_p(n)$ may be considered as the pressure transfer function of the synthesis monopole.

In some embodiments as described below in more detail, the contribution of a synthesis monopole is dependent on an amplification factor and a delay.

The amplification factor of a synthesis monopole may for example be chosen to be inverse proportional to the relative distance between the target monopole and the synthesis monopole.

In other embodiments the amplification factor is further modified by a mapping factor.

In some embodiments, the amplification factor of a synthesis monopole is chosen to be inversely proportional to the relative distance between the target monopole and the synthesis monopole for larger value of the relative distance, but to converge to one for small values of the relative distance. This may avoid that the amplitude is approaching infinity when the relative distance between a synthesis and the target monopole approaches zero.

According to an embodiment, the amplification factor $a_p$ is determined according to equation $$a_p = \frac{1}{\sqrt{1 + r^2}}$$

where $r = R_{p0} = |r_o - r_p|$ is the relative distance between the target monopole at target position $r_o$ and a synthesis monopole indexed p at position $r_p$.

According to a further embodiment, the delay $n_p$ is determined according to equation $$n_p = t_p/T$$

where T is a sampling period, and $t_p$ is the sound propagation delay for the relative distance $r_{p0} = |r_o - r_p|$ between the target monopole at target position $r_o$ and a synthesis monopole indexed p at position $r_p$.

According to some embodiments, after discretization, the contribution $s_p(n)$, for each synthesis monopole indexed p, is determined according to equation $$s_p(n) = \rho c\, a_p \delta(n - n_p)$$

where $a_p$ is the amplification factor, $n_p$ is the delay, n is a sample number, δ represents Dirac's delta function, ρ represents a mean density of air, and c represents the celerity of sound in air.

According to some embodiments, the sound field of the target monopole may be approximated according to equation $$p(r \mid r_0, \omega) \approx p_A(r \mid r_0, \omega) = -i\rho c \sum_{p=1}^{N} \frac{\sin(k|r_o - r_p|)}{|r_o - r_p|} \cdot \frac{\exp(ik|r - r_p|)}{4\pi|r - r_p|} \cdot e^{-i\omega t}$$

where $p(r|r_0, \omega)$ is the sound field of the target monopole as function of position r and angular frequency ω, $r_o$ is the position of the target monopole, $p_A(r|r_0, \omega)$ is the harmonic signal resulting from the synthesis, k is the wave number corresponding to angular frequency ω, $r_p$ are the positions of synthesis monopoles, ρ represents a mean density of air, and c represents the celerity of sound in air.

The target monopole may be an ideal monopole source described by equation $$p(r|r_0, \omega) = i\rho\omega g_k(r|r_0)$$

where $p(r|r_0, \omega)$ is the sound field of the target monopole as function of position r and angular frequency ω, $r_o$ is the position of the target monopole, k is the wave number corresponding to angular frequency ω, $g_k(r|r_0)$ is a free space Green's function of the monopole at position $r_0$, and ρ represents the mean density of air.

In the methods and embodiments described here, at least one of the synthesis monopoles may be configured according to a mirror image source concept. This may allow positioning a synthesis monopole at a location which corresponds to the mirror image of the loudspeaker, mirrored for example at a ceiling at which the loudspeaker is pointed. The thus generated sound source may be considered as a virtual loudspeaker.

The above methods may be implemented in a device and/or sound rendering system to synthesize a target sound field.

According to an embodiment, a device comprises a processor configured to receive a target source signal which corresponds to a target monopole placed at a target position, and to determine, based on the target source signal, contributions of a predefined number of synthesis monopoles placed at respective synthesis positions, the synthesis monopoles being configured to synthesize the target source signal.

The processor may be configured to determine the contributions of the synthesis monopoles according to the methods and embodiments described above and disclosed in more detail below.

A system may comprise the device for determining the contributions of the synthesis monopoles, and a set of loudspeakers, each loudspeaker being associated with a respective synthesis monopole and being configured to render the contribution which is associated with the respective synthesis monopole.

According to the embodiments, the system may be a virtual sound system and/or a surround sound system. The system may comprise any kind of loudspeaker combinations, such as any combinations of front speakers, rear speakers, center speakers, subwoofers, virtual speakers (using ceiling reflections), or the like.

At least one loudspeaker may integrate a supplementary actuator in a classical loudspeakers enclosure and use room reflections for the creation of virtual sound sources (for example by ceiling reflections).

The actuator may be selected in a way to generate a directive radiation, which is not conflicting with the direct sound of the main enclosures and is emitting in a different direction.

According to some embodiments, at least one loudspeaker comprises a directive actuator that is of the horn loudspeaker type.

According to some embodiments, a directive actuator is generated by a loudspeaker array.

According to some embodiments, actuators generate multiple directivity characteristics, each of these characteristics being used to create a virtual sound source from a room reflection.

According to some embodiments, the system comprises a processing unit which is configured to apply Head Related Transfer Functions to the output signals of the renderer to create at least one virtual loudspeaker. The processor may be the same processor which computes the synthesis contributions, or it may be a processor which is different from the processor which computes the synthesis contributions.

Further, the system may also comprise cross-talk cancellation filters configured to generate cross-talk compensated signals from the input signals of the Head Related Transfer Functions. The cross-talk cancellation filters may be implemented as a separate device, or they may be implemented by the same processor which applies Head Related Transfer Functions and/or computes the synthesis contributions.

The system description derived from the solution of the equations presented below may be simple to handle and can be implemented in a computationally efficient way.

According to some of the embodiments, a system is achieved which is simple to realize, flexible and scalable with respect to the number and locations of the enclosures.

According to some embodiments, all enclosures may be always active and give correspondingly a subjective impression of spatial continuity and envelopment with an extended sweet spot.

Monopole Synthesis Principle

The mathematical principles behind the embodiments and the calculations performed in the embodiments are now described in more detail with reference to equations and drawings.

The monopole source according to the embodiments may be seen as the simplest acoustic unit, which can be considered, a simple-harmonic point source, which is emitting in a free field. Mathematically, the monopole is closely related to the free space Green's function:

$$g_k(r, r_0) = \frac{1}{4\pi R} e^{ikR} \tag{1}$$

where R is the distance between r and $r_0$ $$R^2 = |r - r_o|^2 \tag{2}$$

And k is the wave number $$k = \frac{\omega}{c} = \frac{2\pi f}{c}, \text{ with } c = 343.2 \text{ m/s at } 20° \text{ C.} \tag{3}$$

c is the celerity of sound in air, ω is the angular frequency, f the frequency of the sound wave considered. r represents the measurement point, respectively $r_0$ the source location. If we consider the air flow outward from the origin is $S_\omega e^{-i\omega t}$, the corresponding wave motion is:

$$\begin{aligned} p(\omega, r, r_0) = p(\omega, R) = p_s(\omega)e^{-i\omega t} &= -i\rho\omega S_\omega g_k(r, r_o)e^{-i\omega t} \\ &= -\frac{i\rho\omega}{4\pi R} S_\omega e^{ik(R-ct)}, \end{aligned} \tag{4}$$

where $\rho = 1.204$ kg/m$^3$ is the mean density of air at 20° C.

In the time domain, the related inverse Fourier transform of (4) gives:

$$p(t, R) = \int_{-\infty}^{+\infty} -\frac{i\rho\omega}{4\pi R} S_\omega e^{-ikR} d\omega = \frac{\rho}{4\pi R} S'(t - R/c) \tag{5}$$

S (in m$^3$/s) gives the instantaneous value of the total flow of air away from the centre of the source. The pressure at distance R is proportional to the rate of change of this flow at time R/c earlier. For example, if the flow outward started suddenly, being zero for t<0 and 1 for t>0, the generated pressure wave would be a pulse:

$$\frac{\rho}{4\pi R} \delta(t - R/c) \tag{6}$$

The Monopole synthesis according to this embodiment consists in approaching a defined sound field p(r,ω) at point r in the least square sense with a limited set of monopoles. The approximated sound field $p_A(r,\omega)$ is the sum of N monopoles with complex amplitude $A_n(k)$ $$\begin{aligned} p(r, \omega) \approx p_A(r, \omega) &= -i\rho\omega \sum_{n=1}^{N} A_n(k) \cdot g_k(r, r_n) \\ &= -i\rho\omega \sum_{n=1}^{N} A_n(k) \cdot \frac{\exp(ik|r - r_n|)}{4\pi|r - r_n|} \end{aligned} \tag{7}$$

For simplicity of notation, we will remove the wave number index k or angular frequency ω indexes, when working in the complex frequency domain. The approximation is done in the mean square sense on a surface S surrounding the monopoles. The procedure of determination comprises finding the best approximation of the complex pressure p(r), in the least square sense, which minimizes the function F(A) defined as:

$$F(A) = \int_S |p(r) - p_A(r)|^2 dS \tag{8}$$

Virtual Monopole Source

We reformulate the function to minimize $p(r) - p_A(r)$ in the case where p(r) is also generated by a monopole placed at the position $r_0$:

$$p(r|r_0) = -i\rho\omega A_0 g_k(r|r_0) \tag{9}$$

which gives $$p_{A0}(r) = p_A(r) - p(r \mid r_0) = -i\rho\omega \sum_{n=0}^{N} A_n \cdot g_k(r \mid r_n) \tag{10}$$

by using $A_0=-1$. The distance to be minimized on the surface S can be reformulated as:

$$|p(r \mid r_0) - p_A(r)|^2 = p_{A0}^2(r) = p_{A0}(r) \cdot p_{A0}^*(r) \tag{11}$$

$$= (\rho\omega)^2 \sum_{p=0}^{N} A_p \cdot g_k(r \mid r_p) \cdot \sum_{q=0}^{N} A_q^* \cdot g_k^*(r \mid r_q) \tag{12}$$

$$= (\rho\omega)^2 \sum_{p=0}^{N} \sum_{q=0}^{N} A_p \cdot A_q^* \cdot g_k(r \mid r_p) \cdot g_k^*(r \mid r_q) \tag{13}$$

$$= (\rho\omega)^2 \sum_{p=0}^{N} \sum_{q=0}^{N} A_p \cdot A_q^* \cdot g_p \cdot g_q^* \tag{14}$$

The integration of $p_{A0}^2(r)$ over S leads to the integration of the product of $N^2$ pairs of Green functions.

By using for S a sphere of radius r surrounding the set of monopoles, F(A) becomes the sum of integrations in the form:

$$\int_S g_p \cdot g_p^* dS = \int_0^{2\pi} \int_0^{\pi} g_k(r \mid r_p) \cdot g_k^*(r \mid r_q) \cdot r^2 \cdot \sin\vartheta \cdot d\vartheta \cdot d\varphi \tag{15}$$

$$\text{with: } g_p \cdot g_p^* = g_k(r \mid r_p) \cdot g_k^*(r \mid r_q) = \frac{1}{(4\pi)^2} \cdot \frac{e^{ik(|r-r_p|-|r-r_q|)}}{|r-r_p||r-r_q|} \tag{16}$$

In the particular case, where P and Q are placed at the origin ($r_p=r_q=0$), the previous two equations become $$g_p \cdot g_q^* = \frac{1}{(4\pi)^2 r^2} \tag{17}$$

$$\text{and } \int_S g_p \cdot g_q^* dS = \frac{1}{4\pi} \tag{18}$$

The main difficulty results here from the Euclidean distance terms $|r-r_{p,q}|$ in the function to be integrated. There is a way to get around it by using the development of the Green function in its spherical polar coordinates.

FIG. 1 [r, ϕ, θ] of a point in a Cartesian coordinate system with axis x, y and z.

In spherical coordinates:

$$r=[r,\phi,\theta] \text{ and } r_0=[r_0,\phi_0,\theta_0] \tag{19}$$

According to "Theoretical Acoustics", Philip M. Morse and K. Uno Ingard, Princeton University PressMorse, 1986, equation 7.2.31, the Green function can be expanded onto the basis of the so-called Spherical Harmonics.

$$g_k(r \mid r_0) = \frac{ik}{4\pi} h_0(kR(r_0)) \tag{20}$$

-continued $$g_k(r \mid r_0) = \frac{ik}{4\pi} \sum_{l,m,\sigma} \varepsilon_m (2l+1) \frac{(l-m)!}{(l+m)!} Y_{lm}^{\sigma}(\vartheta, \varphi) \cdot Y_{lm}^{\sigma}(\vartheta_0, \varphi_0) \cdot \begin{cases} h_l(kr) \cdot j_l(kr_0) & \text{for } r > r_0 \\ j_l(kr) \cdot h_l(kr_0) & \text{for } r < r_0 \end{cases} \tag{21}$$

$$\text{with } \varepsilon_0 = 1 \text{ and } \varepsilon_m = 2, \text{ for } m > 0 \tag{22}$$

$$\text{for } \sigma = 1,\ Y_{lm}^{1}(\vartheta, \varphi) = \cos(m\varphi)(1-x^2)^{\frac{m}{2}} \frac{d^m}{dx^m} P_l(x),\ x = \cos\vartheta \tag{23}$$

$$\text{for } \sigma = -1,\ Y_{lm}^{-1}(\vartheta, \varphi) = \sin(m\varphi)(1-x^2)^{\frac{m}{2}} \frac{d^m}{dx^m} P_l(x),\ 0 < m \le l \tag{24}$$

$$Y_l(\vartheta) = Y_{l0}^{1}(\vartheta, \varphi) = P_l(\eta) Y_{l0}^{-1}(\vartheta, \varphi) = 0, \text{ for } m = 0 \tag{25}$$

$h_l(x)$ and $j_l(x)$ are respectively the spherical Hankel and Bessel functions of order $l$ (26)

$h_l(x)=j_l(x)+iy_l(x)$, with $y_l(x)$ the spherical Neumann function of order $l$ (27)

For example, we show the terms of $0^{th}$ order $j_0(x)=\sin x/x, y_0(x)=-\cos x/x$ (28)

There is an equivalent definition in a complex form, easier to handle due to its symmetry, which is in accordance with the definition 6.8.2 given in "Numerical Recipes in C. The Art of Scientific Computing, 2nd Edition", William H., Flannery Brian P., Teukolsky Saul A. and Vetterling William T. Cambridge University Press, New York, 1992:

$$g_k(r \mid r_0) = ik \sum_{l=0}^{\infty} \sum_{m=-l}^{m=l} Y_{lm}(\vartheta, \varphi) \cdot Y_{lm}^*(\vartheta_0, \varphi_0) \cdot \begin{cases} h_l(kr) \cdot j_l(kr_0) & \text{for } r > r_0 \\ j_l(kr) \cdot h_l(kr_0) & \text{for } r < r_0 \end{cases} \tag{29}$$

These complex spherical harmonics of the first kind $Y_{lm}(\theta, \phi)$, $l \ge 0$, $-m \le l \le m$ are defined by the equations:

$$Y_{lm}(\vartheta, \varphi) = \sqrt{\frac{(2l+1)(l-m)!}{4\pi(l+m)!}} \cdot P_l^m(\cos\vartheta) \cdot e^{im\varphi}, \text{ for } m \ge 0 \tag{30}$$

By using the relation:

$$\text{For } m \ge 0: \tag{31}$$

$$Y_{l,-m}(\vartheta, \varphi) = (-1)^m \cdot Y_{lm}^*(\vartheta, \varphi) = (-1)^m \cdot \sqrt{\frac{(2l+1)(l-m)!}{4\pi(l+m)!}} \cdot P_l^m(\cos\vartheta) \cdot e^{-im\varphi}$$

We can always relate a spherical harmonic to the associated Legendre polynomials:

$$P_l^m(x) = (1-x^2)^{\frac{m}{2}} \frac{d^m}{dx^m} P_l(x) \tag{32}$$

It can be rewritten in the normalized form:

$$Y_{lm}(\vartheta, \varphi) = (-1)^m \cdot \frac{1}{\sqrt{2\pi}} \cdot N_l^m(\cos\vartheta) \cdot e^{im\varphi} \tag{33}$$

$N_l^m(x)$ is the fully normalized Associated Legendre function, with the following properties:

$$N_l^m(x) = (-1)^m \cdot \frac{1}{\sqrt{2}} \cdot \sqrt{\frac{(2l+1)(l-m)!}{(l+m)!}} \cdot P_l^m(x) \tag{34}$$

$$\int_{-1}^{1} (N_l^m(x))^2 dx = \int_0^{\pi} (N_l^m(\cos\vartheta))^2 \sin\vartheta d\vartheta = 1 \tag{35}$$

$$\int_{-1}^{1} N_l^m(x) \cdot N_p^m(x) dx = \int_0^{\pi} N_l^m(\cos\vartheta) \cdot N_p^m(\cos\vartheta) \cdot \sin\vartheta \cdot d\vartheta \neq 0, \quad \text{if } l \neq p \tag{36}$$

The spherical harmonics have consequently the following orthonormal property:

$$\int_0^{2\pi}\int_0^{\pi} Y_{lm}(\theta,\phi) \cdot Y_{pq}^*(\theta,\phi) \cdot \sin\theta \cdot d\theta \cdot d\phi = \delta_{lp} \cdot \delta_{mq} \tag{37}$$

The Green function can then be rewritten using the complex normalized form:

$$g_k(r \mid r_0) = \frac{ik}{2\pi} \cdot \sum_{l=0}^{\infty} \sum_{m=-1}^{l} N_l^{|m|}(\cos\vartheta) \cdot N_l^{|m|}(\cos\vartheta_0) \cdot e^{im(\varphi-\varphi_0)} \cdot \begin{cases} h_l(kr) \cdot j_l(kr_0) & \text{for } r > r_0 \\ j_l(kr) \cdot h_l(kr_0) & \text{for } r < r_0 \end{cases} \tag{38}$$

Or equivalently by using the symmetry properties with respect to m, we can also use the following relationship:

$$g_k(r \mid r_0) = \frac{ik}{2\pi} \cdot \sum_{l=0}^{\infty} \sum_{m=-1}^{l} \varepsilon_m \cdot N_l^{|m|}(\cos\vartheta) \cdot N_l^{|m|}(\cos\vartheta_0) \cdot \cos(m(\varphi-\varphi_0)) \cdot \begin{cases} h_l(kr) \cdot j_l(kr_0) & \text{for } r > r_0 \\ j_l(kr) \cdot h_l(kr_0) & \text{for } r < r_0 \end{cases} \tag{39}$$

Figure 2:
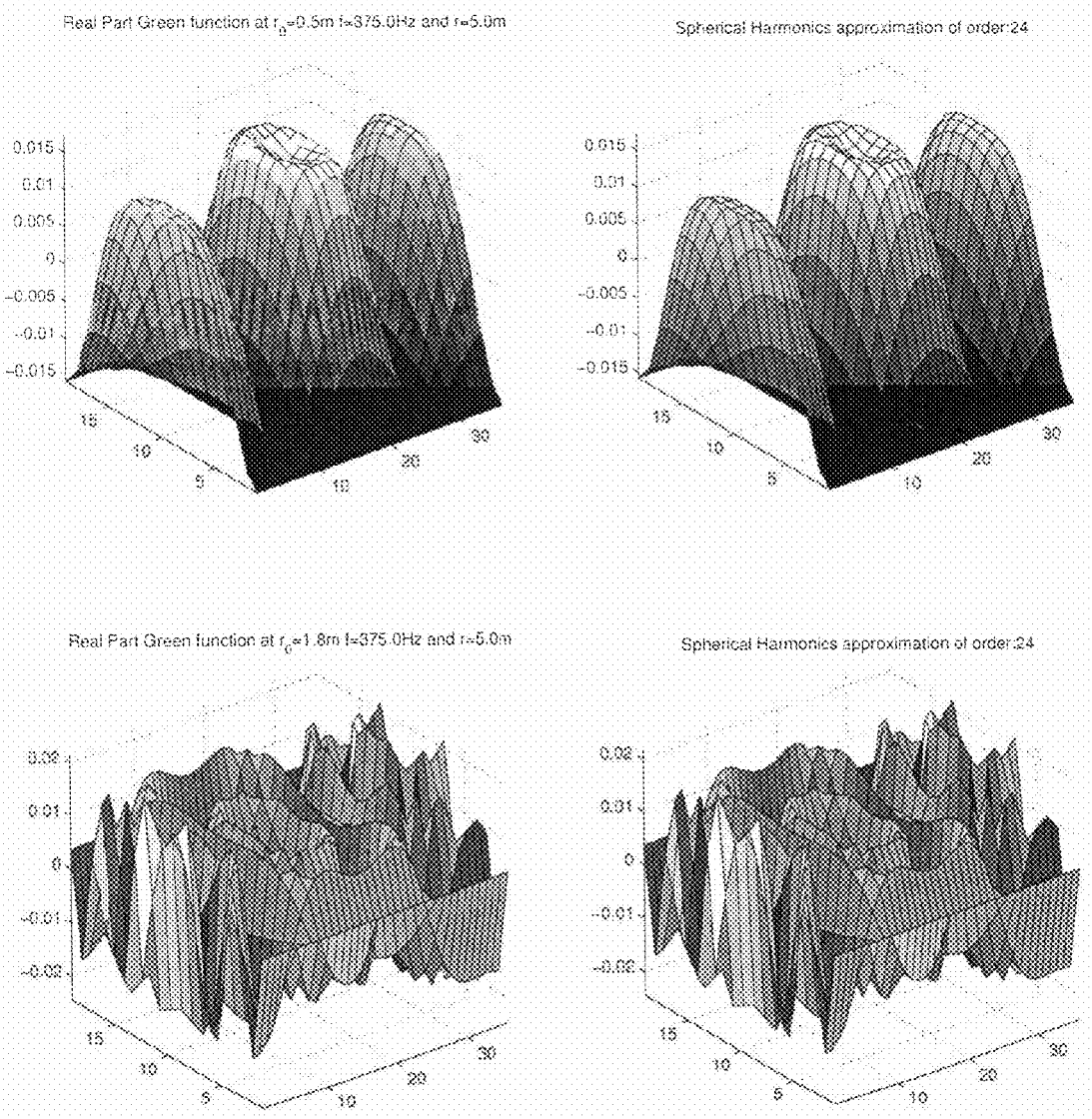
FIG. 2 gives two examples of an approximation of the Green function using Spherical Harmonics.

FIG. 2 provides a comparison of the Green function using $r_0$=0.5 m (top) and $r_0$=1.8 m (bottom) at frequency f=375 Hz and r=5 m with their approximation using a spherical harmonics decomposition of order l=24.

In spherical coordinates, the coefficients $g_p$ can be written in their complex form:

$$g_p = ik \sum_{l=0}^{\infty} \sum_{m=-l}^{m=l} Y_{lm}(\vartheta, \varphi) \cdot Y_{lm}^*(\vartheta_p, \varphi_p) \cdot h_l(kr) \cdot j_l(kr_p) \text{ for } r > r_p \tag{40}$$

for an easier handling, we simplify the previous formula by suppressing the implicit angles dependency in θ and ϕ with:

$$g_p = ik \sum_{l,m} Y_{lm} \cdot Y_{lm}^*(\vartheta_p, \varphi_p) \cdot h_l(kr) \cdot j_l(kr_p) \tag{41}$$

The product $g_p \cdot g_q^*$ can be then written as:

$$g_p \cdot g_q^* = k^2 \sum_{l,m} \sum_{n,j} Y_{lm} \cdot Y_{nj} \cdot Y_{lm}^*(\vartheta_p, \varphi_p) \cdot Y_{nj}(\vartheta_q, \varphi_q) \cdot h_l(kr) \cdot h_n^*(kr) \cdot j_l(kr_p) \cdot j_n(kr_q) \tag{42}$$

The integral of the product $g_p \cdot g_q^*$ on a sphere S of radius r can be written in its spherical harmonics decomposition as:

$$\int_S g_p \cdot g_q^* dS = r^2 k^2 \sum_{l,m,n,j} \delta_{lm} \cdot \delta_{nj} \cdot Y_{lm}^*(\vartheta_p, \varphi_p) \cdot Y_{nj}(\vartheta_q, \varphi_q) \cdot h_l(kr) \cdot h_n^*(kr) \cdot j_l(kr_p) \cdot j_n(kr_q) \tag{43}$$

by using the orthonormality property of the spherical harmonics, where $\delta_{lm} \cdot \delta_{nj}$=1, only for l=n and m=j and 0 otherwise. We obtain consequently:

$$\int_S g_p \cdot g_p^* dS = (kr)^2 \sum_{l,m} Y_{lm}^*(\vartheta_p, \varphi_p) \cdot Y_{lm}(\vartheta_q, \varphi_q) \cdot h_l(kr) \cdot h_l^*(kr) \cdot j_l(kr_p) \cdot j_l(kr_q)$$

Or in its complex normalized form:

$$\frac{(kr)^2}{2\pi} \sum_{l,m} N_l^{|m|}(\cos\vartheta_p) \cdot N_l^{|m|}(\cos\vartheta_q) \cdot e^{im(\varphi_p-\varphi_q)} \cdot h_l(kr) \cdot h_l^*(kr) \cdot j_l(kr_p) \cdot j_l(kr_q) \tag{44}$$

using the relationship 10.1.26 and 10.1.27 of the "Handbook of Mathematical Functions", Milton Abramowitz and Irene A. Stegun, 9th Edition, Dover Publications, Inc., 1970:

$$h_l(kr) \cdot h_l^*(kr) = j_l^2(kr) + y_l^2(kr) \tag{45}$$

$$= \frac{1}{2} \cdot \frac{\pi}{z} \cdot M_{l+\frac{1}{2}}^2(z), \text{ with } z = kr \tag{46}$$

$$= \frac{1}{z^2} \cdot \sum_{p=0}^{l} \frac{(2l-p)!(2l-2p)!}{p![(l-p)!]^2} \cdot (2z)^{2p-2l} \tag{47}$$

The first 3 orders of development of the full expression are the following ones:

$$l = 0: \ \frac{1}{2} \cdot \frac{\pi}{2} \cdot M_{1/2}^2(z) = z^{-2} \tag{48}$$

$$l = 1: \ \frac{1}{2} \cdot \frac{\pi}{2} \cdot M_{3/2}^2(z) = z^{-2} + z^{-4} \tag{49}$$

$$l = 2: \ \frac{1}{2} \cdot \frac{\pi}{2} \cdot M_{5/2}^2(z) = z^{-2} + 3z^{-4} + 9z^{-6} \tag{50}$$

For very large value of z, the previous expression is dominated by the lowest order of z power for p=l and the limit is correspondingly:

$$\lim_{z\to\infty}\frac{1}{2}\cdot\frac{\pi}{z}\cdot M^2_{l+\frac{1}{2}}(z)=z^{-2} \tag{51}$$

On the other way round, for very small value of z, the expression is dominated by its highest order for p=0 and the limit is correspondingly:

$$\lim_{z\to 0}\frac{1}{2}\cdot\frac{\pi}{z}\cdot M^2_{l+\frac{1}{2}}(z)=z^{-2(l+1)}\cdot\left[\prod_{p=1}^{l}(l+p)\right]^2\Big/4^l \tag{52}$$

Let us define the following functions:

$$\mathcal{G}(z,l,p)=\frac{(2l-p)!(2l-2p)!}{p![(l-p)!]^2}\cdot\frac{1}{4^{(l-p)}z^{2(l-p)}}=\frac{G_{lp}}{z^{2(l-p)}} \tag{53}$$

Such that $$\frac{1}{2}\cdot\frac{\pi}{2}\cdot M^2_{l+\frac{1}{2}}(z)=\frac{1}{z^2}\cdot\sum_{p=0}^{l}\mathcal{G}(z,l,p)$$

and $$\mathcal{F}(z,l)=z^2\cdot\frac{1}{2}\cdot\frac{\pi}{z}\cdot M^2_{l+\frac{1}{2}}(z)=\sum_{p=0}^{l}\mathcal{G}(z,l,p) \tag{54}$$

The limits in these cases can be rewritten:

$$\lim_{z\to\infty}\mathcal{F}(z,l)=1 \tag{55}$$

$$\lim_{z\to 0}\mathcal{F}(z,l)=z^{-2l}\cdot\left[\prod_{p=1}^{l}(l+p)\right]^2\Big/4^l \tag{56}$$

Figure 3:
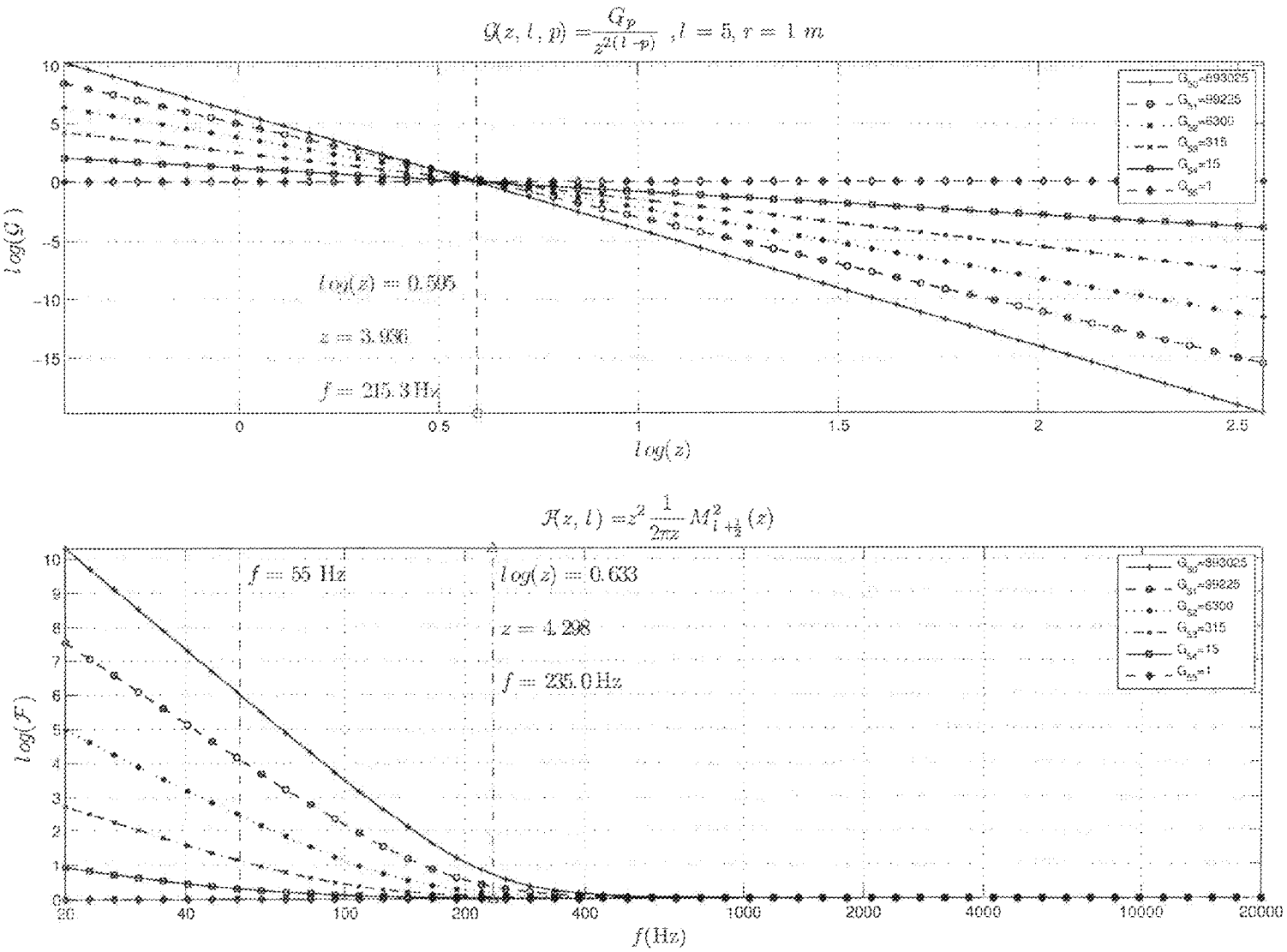
FIG. 3 provides a double logarithmic plot of functions G(z, l, p) and F(z, l) with dependency of z for order l=5 and p∈[0 . . . l]

FIG. 3 provides a double logarithmic plot of functions G(z, l, p) and F(z, l) with dependency of z for order l=5 and p∈[0 . . . l]. The plots illustrate the evolution of these functions as a dependency of the number of p coefficients used in the sum for order l=5. The top plot of G(z, l, p) shows the decreasing lines of slopes −2(l−p), showing the dominant component for p=l, when z→∞ and p=0 for z→0. The value of the intersection point of order p=0 with p=1 is also given. The maximum value of all other intersection points is given on the lower plot. These values are converted back to frequency assuming z=kr with r=1 m. In the case of a commonly stated range of human hearing between frequency 20 Hz and 20 kHz, the domain of value for k is ranging from around 0.365 to 365. For k=1, f=kc/2π is around 55 Hz.

The final expression of F(A) can be rewritten using the Jacobian function J(A):

$$\begin{aligned}F(A)&=(\rho\omega)^2\cdot\frac{1}{2\pi}\cdot J(A)\\&=(\rho\omega)^2\cdot\frac{1}{2\pi}\sum_{p=0}^{N}\sum_{q=0}^{N}A_p\cdot A_q^*\cdot\sum_{l,m}\mathcal{F}(kr,l)\cdot\\&\quad N_l^{|m|}(\cos\vartheta_p)\cdot N_l^{|m|}(\cos\vartheta_q)\cdot\\&\quad e^{im(\varphi_p-\varphi_q)}\cdot j_l(kr_p)\cdot j_l(kr_q)\end{aligned} \tag{57}$$

J(A) can be rewritten in the following form:

$$J(A)=\sum_{p=0}^{N}\sum_{q=0}^{N}A_p\cdot A_q^*\cdot\Gamma_{pq} \tag{58}$$

with:

$$\begin{aligned}\Gamma_{pq}=\sum_{l=0}^{\infty}\sum_{m=-l}^{l}&\mathcal{F}\\&(kr,l)\cdot N_l^{|m|}(\cos\vartheta_p)\cdot N_l^{|m|}(\cos\vartheta_q)\cdot e^{im(\varphi_p-\varphi_q)}\cdot j_l(kr_p)\cdot j_l(kr_q)\end{aligned} \tag{59}$$

we have $\Gamma_{pq}=\Gamma_{qp}^*$.

Separating the known components of the sound source, for p=0 and q=0, $A_0=-1$, J(A) can be rewritten in the form:

$$J(A)=\Gamma_{00}-\left(\sum_{q=1}^{N}A_q^*\cdot\Gamma_{0q}+A_q\cdot\Gamma_{0q}^*\right)+\sum_{p=1}^{N}\sum_{q=1}^{N}A_p\cdot A_q^*\cdot\Gamma_{pq} \tag{60}$$

using the real and imaginary part of A ($A_q=x_q+iy_q$), we can rewrite the previous expressions separately:

$$\sum_{p=1}^{N}A_q^*\cdot\Gamma_{0q}+A_q\cdot\Gamma_{0q}^*=\sum_{q=1}^{N}x_q\cdot(\Gamma_{0q}+\Gamma_{0q}^*)+i\sum_{q=1}^{N}y_q\cdot(\Gamma_{0q}^*-\Gamma_{0q}) \tag{61}$$

$$\begin{aligned}\sum_{p=1}^{N}\sum_{q=1}^{N}A_p\cdot A_q^*\cdot\Gamma_{pq}&=\\&\sum_{p=1}^{N}\sum_{q=1}^{N}[(x_p\cdot x_q+y_p\cdot y_q)+i(y_p\cdot x_q-x_p\cdot y_q)]\cdot\Gamma_{pq}\end{aligned} \tag{62}$$

Using the following relationships:

$$e^{-im(\phi_p-\phi_q)}+e^{im(\phi_p-\phi_q)}=2\cdot\cos(m(\phi_p-\phi_q)) \tag{63}$$

$$e^{-im(\phi_p-\phi_q)}-e^{im(\phi_p-\phi_q)}=2i\cdot\cos(-m(\phi_p-\phi_q)) \tag{64}$$

and defining the vector $A^T=[z_1=x_1, \ldots, z_N=x_N, z_{N+1}=y_1, \ldots, z_{2N}=y_N]$ composed of its concatenated real and imaginary parts and $C^T=[c_1, \ldots, c_{2N}]$, the first term can be rewritten in the matrix form:

$$2\cdot C^TA=2\sum_{q=1}^{2N}c_q\cdot z_q \tag{65}$$

With the coefficients $c_q$ defined as:

$$q \in \{1 \ldots N\}: c_q = \frac{\Gamma_{0q} + \Gamma_{0q}^*}{2} \tag{66}$$

$$c_q = \sum_{l=0}^{\infty} \sum_{m=-l}^{l} \mathfrak{F}(kr, l) \cdot N_l^{|m|}(\cos\vartheta_q) \cdot N_l^{|m|}(\cos\vartheta_0) \cdot j_l(kr_q) \cdot j_l(kr_0) \cdot \cos(m(\varphi_o - \varphi_q)) \tag{67}$$

$$q \in \{N+1 \ldots 2N\}: c_q = i \cdot \frac{\Gamma_{0q}^* - \Gamma_{0q}}{2} \tag{68}$$

$$c_q = \sum_{l=0}^{\infty} \sum_{m=-l}^{l} \mathfrak{F}(kr, l) \cdot N_l^{|m|}(\cos\vartheta_q) \cdot N_l^{|m|}(\cos\vartheta_0) \cdot j_l(kr_q) \cdot j_l(kr_0) \cdot \sin(-m(\varphi_o - \varphi_q)) \tag{69}$$

due to the symmetry in m, sin(−mx)=−sin(mx). In the previous sum, the imaginary part sums to zero leading to $C=[c_1, \ldots c_N, 0_N]$. The same symmetry in m holds for every coefficient $\Gamma_{pq}$ in general. Consequently it is real and symmetric with respect to p and q. It can be rewritten by using the associated Normalized Legendre Polynom as:

$$\Gamma_{pq} = \Gamma_{qp} = \sum_{l=0}^{\infty} \sum_{m=0}^{l} \varepsilon_m \cdot \mathfrak{F}(kr, l) \cdot N_l^m(\cos\vartheta_p) \cdot N_l^m(\cos\vartheta_q) \cdot j_l(kr_p) \cdot j_l(kr_q) \cdot \cos(m(\varphi_p - \varphi_q)) \tag{70}$$

For the second expression, the symmetry in p and q leads to the relationship:

$$\sum_{p=1}^{N} \sum_{q=1}^{N} A_p \cdot A_q^* \cdot \Gamma_{pq} = \sum_{p=1}^{N} \sum_{q=1}^{N} [(x_p \cdot x_q + y_p \cdot y_q)] \cdot \Gamma_{pq} = \sum_{p=1}^{2N} \sum_{q=1}^{2N} z_p \cdot z_q \cdot H_{p,q} \tag{71}$$

with:

$$H = \begin{bmatrix} H_{1,1} = \Gamma_{11} & \ldots & H_{1,N} = \Gamma_{1N} & & & \\ \vdots & \ddots & \vdots & & 0_N & \\ H_{N,1} = \Gamma_{1N} & \ldots & H_{N,N} = \Gamma_{N,N} & & & \\ & & H_{N+1,N+1} = \Gamma_{11} & \ldots & H_{N+1,2N} = \Gamma_{1N} & \\ 0_N & & \vdots & \ddots & \vdots & \\ & & H_{2N,N+1} = \Gamma_{1N} & \ldots & H_{2N,2N} = \Gamma_{NN} & \end{bmatrix} \tag{72}$$

The second term can be rewritten in the matrix form:

$$A^T \cdot H \cdot A \tag{73}$$

Correspondingly, we get the following rewriting:

$$J(A) = \Gamma_{00} - 2C^T \cdot A + A^T \cdot H \cdot A \tag{74}$$

Taking the first and second derivative of this function with respect to the vector A gives:

$$[\nabla J(A)]^T = -2C^T + 2A^T \cdot H \tag{75}$$

$$\nabla^2 J(A) = 2 \cdot H \tag{76}$$

The function J(A) is an exact quadratic form and its Taylor development is also exact to the second order of its partial derivative with respect to the independent variables in A:

$$J(A) = J(0) + [\nabla J(0)]^T \cdot A + \frac{1}{2} \cdot A^T \cdot [\nabla^2 J(0)] \cdot A \tag{77}$$

The minimum of this function is sought for by using Newton's method. The function J(A) has a minimum when its first derivative is 0:

$$0 = 2C^T + 2A^T \cdot H \tag{78}$$

$$A^T = H^{-1} \cdot C^T \tag{79}$$

$$A = -[\nabla^2 J(0)]^{-1} \cdot [\nabla J(0)] \tag{80}$$

Due to the fact that half of the coefficients of the matrix C are zeros, the solution for A can be found by solving the system of linear equations:

$$C = H^T \cdot A \tag{81}$$

which is limited to $$\begin{bmatrix} C_1 \\ \vdots \\ C_N \end{bmatrix} = \begin{bmatrix} \Gamma_{11} & \ldots & \Gamma_{1N} \\ \vdots & \ddots & \vdots \\ \Gamma_{1N} & \ldots & \Gamma_{NN} \end{bmatrix} \cdot \begin{bmatrix} x_1 \\ \vdots \\ x_N \end{bmatrix} \tag{82}$$

Let us now examine the $c_p$ coefficients more closely in light of the important addition theorem of the Bessel functions. According to the already previously cited "Handbook of Mathematical Functions" by Abramowitz (see 10.1.45) we have the following relationship for r, λ, ρ, θ arbitrary complex:

$$\frac{\sin\lambda R}{\lambda R} = \sum_{l=0}^{\infty} (2l+1) \cdot j_l(\lambda r) \cdot j_l(\lambda p) \cdot P_l(\cos\theta) \tag{83}$$

With:

$$R = \sqrt{r^2\rho^2 - 2 \cdot r \cdot \rho\cos\theta} \tag{84}$$

$$c_p = \sum_{l=0}^{\infty} \sum_{m=0}^{m=l} \varepsilon_m \cdot \mathfrak{F}(kr, l) \cdot N_l^m(\cos\vartheta_p) \cdot N_l^m(\cos\vartheta_0) \cdot j_l(kr_p) \cdot j_l(kr_0) \cdot \cos(m(\varphi_p - \varphi_0)) \tag{85}$$

Let us consider first the particular case, where $\phi_p = \phi_0$ and $\theta_0 = 0$, the previous relationship simplifies to:

$$c_p = \sum_{l=0}^{\infty} \sum_{m=0}^{m=l} \varepsilon_m \cdot \mathfrak{F}(kr, l) \cdot N_l^m(\cos\vartheta_p) \cdot N_l^m(1) \cdot j_l(kr_p) \cdot j_l(kr_0) \tag{86}$$

since:

$$N_l^m(\cos\vartheta_p) \cdot N_l^m(1) = \frac{1}{2} \cdot \frac{(2l+1)(l-m)!}{(l+m)!} \cdot P_l^m(\cos\vartheta_p) \tag{87}$$

and $N_l^m(1)=1$, only for $m=0$, and 0 otherwise (88)

the dependency in m disappears completely and we finally get:

$$c_p = \frac{1}{2} \cdot \sum_{l=0}^{\infty} \Psi(kr, l) \cdot (2l+1) \cdot P_l(\cos\vartheta_p) \cdot j_l(kr_p) \cdot j_l(kr_0) \tag{89}$$

Since we are working in spherical coordinates, the previous relationship is also valid in the case of any $\Gamma_{pq}$ coefficient. For any pair of points (P, Q), we can rotate the plane going through (P, O, Q) in a way that it is corresponding to the XY plane and that the X axis corresponds to the axis going through the pair of points (O, P) such resulting in $\phi_p=\phi_q$ and $\theta_q=0$. Consequently:

$$\Gamma_{pq} = \frac{1}{2} \cdot \sum_{l=0}^{\infty} \Psi(kr, l) \cdot (2l+1) \cdot P_l(\cos\vartheta_p) \cdot j_l(kr_p) \cdot j_l(kr_q) \tag{90}$$

Development for Large Value of Kr (Far Field)

In the case of large value of kr the previous expression for $c_p$ becomes, due to the equation (55):

$$\lim_{kr\to\infty} c_p = \frac{1}{2}\sum_{l=0}^{\infty} (2l+1) \cdot P_l(\cos\vartheta_p) \cdot j_l(kr_p) \cdot j_l(kr_0) = \frac{1}{2}\frac{\sin kR_{p0}}{kR_{p0}} \tag{91}$$

$$\text{with } R_{p0}=\sqrt{r_p^2+r_0^2-2\cdot r_p r_0 \cos\theta_P} \tag{92}$$

The previous expression of $\Gamma_{pq}$ becomes:

$$\lim_{kr\to\infty} \Gamma_{pq} = \frac{1}{2}\sum_{l=0}^{\infty} (2l+1) \cdot P_l(\cos\vartheta_p) \cdot j_l(kr_p) \cdot j_l(kr_q) = \frac{1}{2}\frac{\sin kR_{pq}}{kR_{pq}} \tag{93}$$

with:

$$R_{pq}=\sqrt{r_p^2+r_q^2-2\cdot r_p r_q \cos\theta_p} \tag{94}$$

In this case, the system of equations (82) becomes:

$$\begin{bmatrix} \frac{\sin kR_{10}}{kR_{10}} \\ \vdots \\ \frac{\sin kR_{N0}}{kR_{N0}} \end{bmatrix} = \begin{bmatrix} 1 & \cdots & \frac{\sin kR_{1N}}{kR_{1N}} \\ \vdots & \ddots & \vdots \\ \frac{\sin kR_{1N}}{kR_{1N}} & \cdots & 1 \end{bmatrix} \cdot \begin{bmatrix} x_1 \\ \vdots \\ x_N \end{bmatrix} \tag{95}$$

The coefficients of matrix A and C are proportional to sinc functions, which are dependent of the wave number k and the relative distances between the target monopole and the secondary monopoles used for the synthesis.

Figure 4:
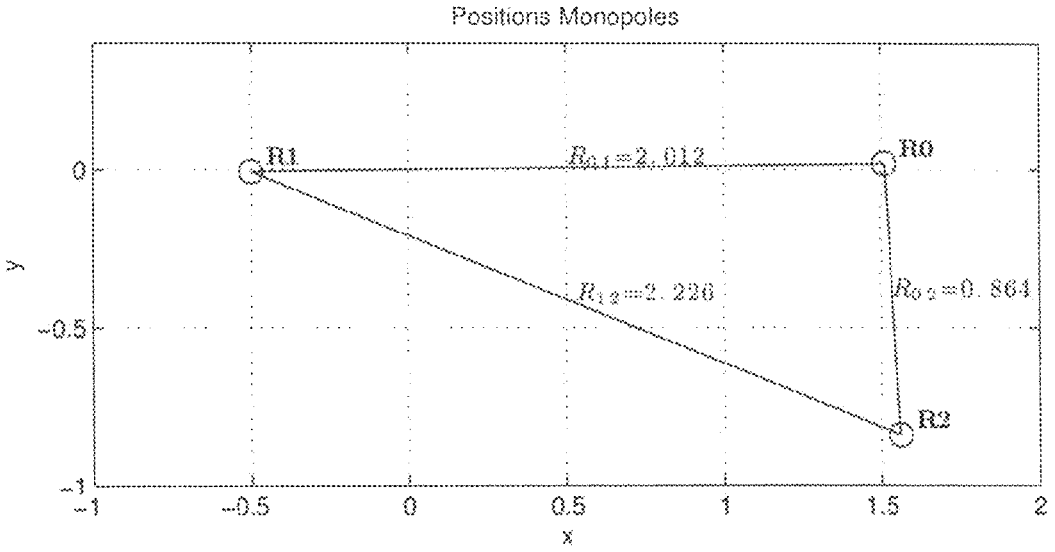
FIG. 4 illustrates the positions and relative distances between monopoles in the case of the synthesis of one monopole with 2 secondary monopoles.

FIG. 4 illustrates the positions and relative distances between monopoles in the case of the synthesis of one monopole R0 using the two secondary monopoles R1 and R2.

Figure 5:
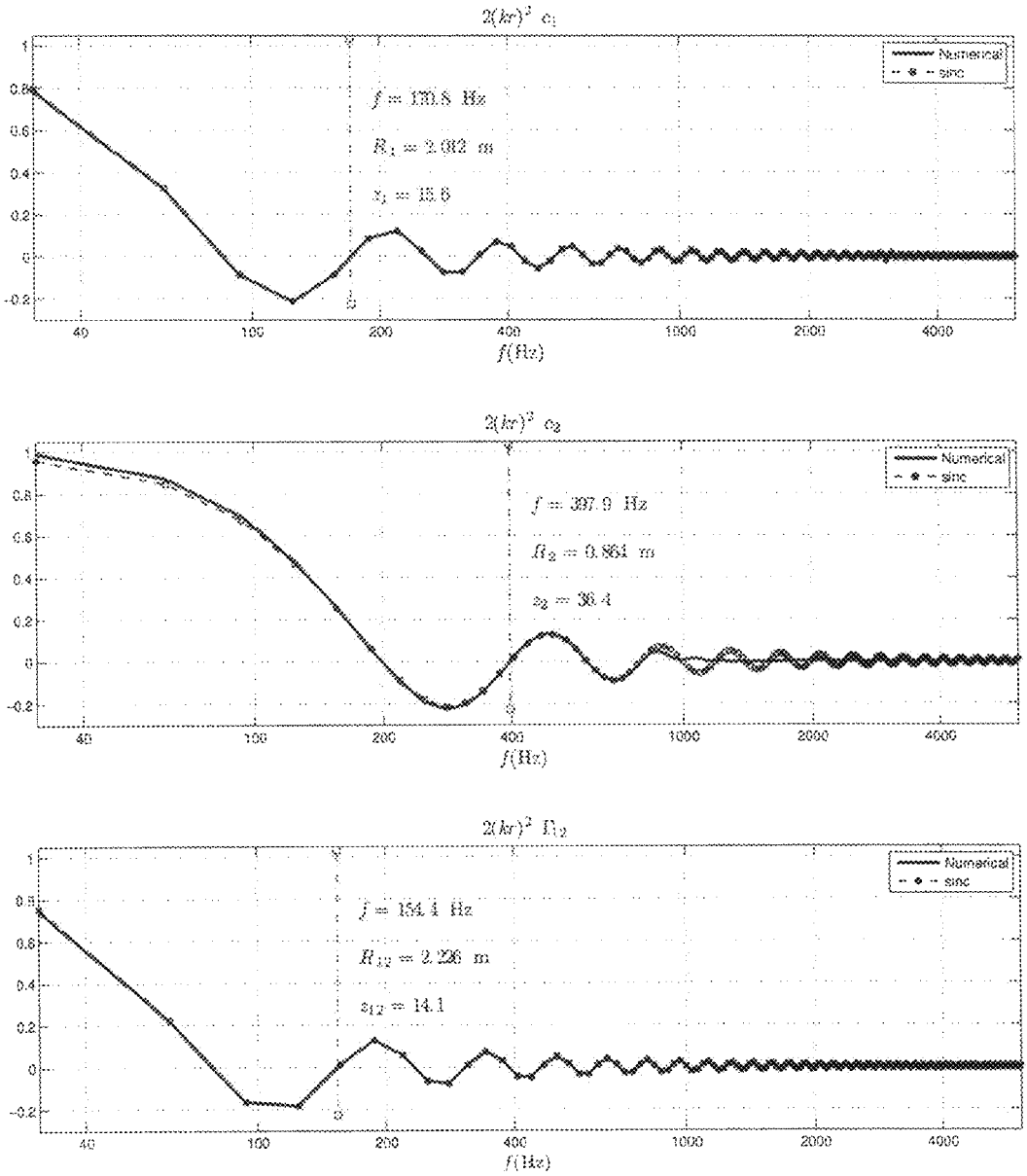
FIG. 5 provides a comparison between the numerical expression derived from the spherical harmonics decomposition (order l=24) and the approximation using sinc function only.

FIG. 5 illustrates the results of this approximation. The thick solid curve shows the result of the computation of the coefficients $c_1$ and $c_2$ as well as $r_{12}$ with an order of the spherical harmonics limited to l=24. The dashed curve with circles shows the corresponding approximation using the sinc function. In all cases, the coefficients are multiplied by the factor $2(kr)^2$ with r=5 m. The highest discrepancy occurs for the lower frequencies with the coefficient $c_2$ where the radius $R_{20}$=0.864 m is the smallest one. For higher frequencies, the difference is due to the limitation of the spherical harmonics order, which results in numerical imprecision.

The main consequence of this observation is that the matrix H is mainly dominated by the diagonal values, which are all ones; the main discrepancy occurs for lower frequencies and smaller radius. The results for the matrix A can be then approximated by the values:

$$A = \begin{bmatrix} x_1 \\ \vdots \\ x_N \end{bmatrix} = \begin{bmatrix} \frac{\sin kR_{10}}{kR_{10}} \\ \vdots \\ \frac{\sin kR_{N0}}{kR_{N0}} \end{bmatrix} \tag{96}$$

Figure 6:
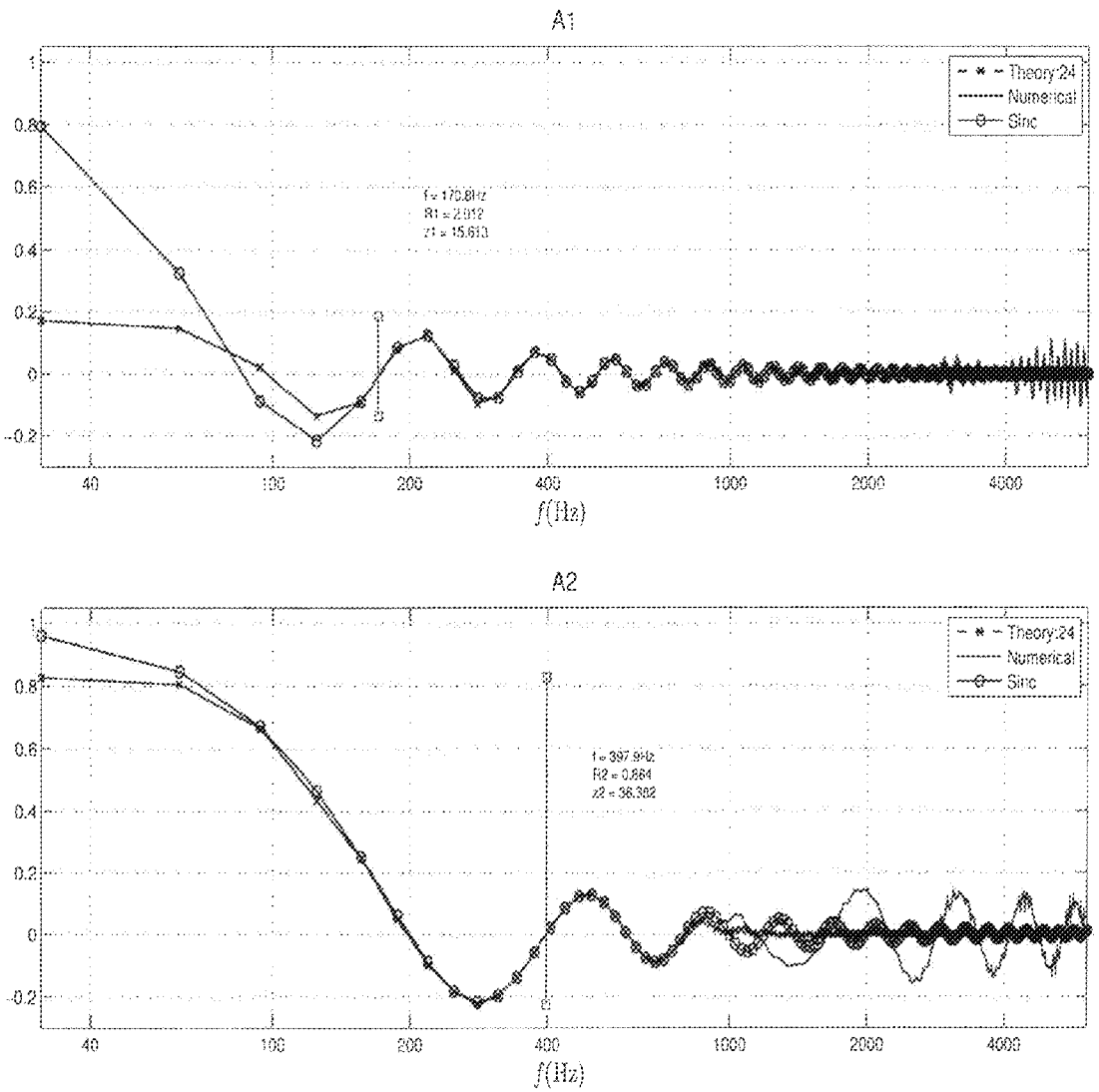
FIG. 6 provides the results of a computation of the amplitude with spherical harmonics decomposition (order l=24), numerical integration on sphere and approximation with sinc.

The amplitude is only depending from the distance between the simulated source and the monopoles used for the synthesis. FIG. 6 shows the difference between the solutions of equation (95) using an order l=24 of the spherical harmonics decomposition and the approximation (96) using sinc functions instead.

This approximation may provide the basis for a real-time implementation of the monopole synthesis.

FIG. 6 provides the results of a computation of the amplitude with spherical harmonics decomposition (order l=24, dashed line with crosses), numerical integration on sphere (continuous line) and approximation with sinc (continuous line with circles). Here also the numerical integration becomes imprecise for higher frequencies.

We finally obtain the pressure transfer function for each monopole p:

$$S_p(\omega) = -i\rho\omega x_p = -i\rho\omega\frac{\sin kR_{p0}}{kR_{p0}} = -i\rho c\frac{\sin kR_{p0}}{R_{p0}} \tag{97}$$

The final pressure $p_A(r, \omega)$ for an harmonic signal resulting from the monopole synthesis is consequently:

$$p_A(r, \omega) = -i\rho c\sum_{p=1}^{N} \frac{\sin(k|r_o - r_p|)}{|r_o - r_p|} \cdot \frac{\exp(ik|r - r_p|)}{4\pi|r - r_p|} \cdot e^{-i\omega t} \tag{98}$$

Equation (97) can be rewritten as $$S_p(\omega) = -i\rho c\frac{\sin kR_{p0}}{R_{p0}} = i\frac{\rho}{t_p}\sin(-\omega t_p), \tag{99}$$

with $$t_p = \frac{R_{p0}}{c}$$

$t_p$ is the sound propagation delay for the distance $R_{p0}$ between monopole p used for synthesis and the target monopole. This transfer function can be rewritten using Euler's relationship:

$$S_p(\omega) = \frac{\rho}{2t_p}[e^{-i\omega t_p} - e^{i\omega t_p}] \tag{100}$$

Using its inverse Fourier transform defined as $$s_p(t) = \int_{-\infty}^{+\infty} S_p(\omega) \cdot e^{i\omega t} d\omega \tag{101}$$

results in the impulse response:

$$s_p(t) = \frac{\rho}{2t_p}[\delta(t - t_p) - \delta(t + t_p)] \tag{102}$$

Numerical Implementation

In a numerical implementation, the previous equations are discretized. We work now with a discrete time signal and sequences of values. Many sequences can be represented by a Fourier Integral of the form:

$$x[n] = \frac{1}{2\pi}\int_{-\pi}^{\pi} X(e^{i\omega})e^{i\omega n} d\omega \tag{103}$$

where:

$$X(e^{i\omega}) = \sum_{n=-\infty}^{\infty} x[n]e^{-i\omega n} \tag{104}$$

The corresponding Discrete Fourier Transform for periodic sequences of length M, which are used for numerical implementation is defined as $$\tilde{X}(m) = \sum_{n=0}^{M-1} \tilde{x}[n]e^{-i2\pi mn/N} \tag{105}$$

respectively, its inverse $$\tilde{x}[n] = \frac{1}{M}\sum_{m=0}^{M-1} \tilde{X}(m)e^{i2\pi mn/N} \tag{106}$$

We use the notation T for the sampling period and M the number of samples used for a particular digital filter. Let us consider the transfer function:

$$X_p(m)=e^{-2\pi i \cdot n_p \cdot m/M}, \text{ with } m\epsilon[-M/2 \ldots 0 \ldots M/2-1] \text{ and } n_p=t_p/T \tag{107}$$

$n_p$ is a real value directly proportional to the delay. The monopole transfer function can be rewritten in term of this function $$S_p(m) = \frac{\rho}{2t_p}[X_p(m) - X_p^*(m)] \tag{108}$$

The function $X_p(m)$ can be rewritten:

$$X_p(m)=e^{-\pi i \cdot n_p \cdot (m-M/2)/M} \text{ with } m\epsilon[0 \ldots M-1] \tag{109}$$

Considering M as the number of coefficients of the inverse Discrete Fourier Transform of this sequence, we obtain:

$$\begin{aligned} x_p(n) &= \frac{1}{M} \cdot \sum_{m=0}^{M-1} e^{-2\pi i \cdot n_p \cdot (m-\frac{M}{2})/M} \cdot e^{2\pi i \cdot n \cdot m/M} \\ &= \frac{1}{M} e^{\pi i \cdot n_p} \cdot \sum_{m=0}^{M-1} e^{2\pi i \cdot (n-n_p) \cdot m/N} \end{aligned} \tag{110}$$

according to equation (3-64) of "Understanding Digital Signal Processing", Richard G. Lyons, Addison Wesley, 1997, this series converges to the expression:

$$\begin{aligned} x_p(n) &= \frac{1}{M} \cdot e^{\pi i \cdot n_p} \cdot e^{\pi i (n-n_p) \cdot (M-1)/M} \frac{\sin[\pi(n-n_p)]}{\sin[\pi(n-n_p)/M]} \\ &= \frac{1}{M} \cdot (-1)^n \cdot e^{-\pi i (n-n_p)/M} \frac{\sin[\pi(n-n_p)]}{\sin[\pi(n-n_p)/M]} \end{aligned} \tag{111}$$

$x_p(n)$ is composed of the multiplication of the real part of the DFT of a rectangular window of size M, the so-called Dirichlet kernel, centered on the value $n_p$:

$$W_p(n) = \frac{\sin[\pi(n-n_p)]}{\sin[\pi(n-n_p)/M]} \tag{112}$$

with half a period of a complex exponential centred also on the same value $n_p$ and oscillating in sign every sample $(-1)^n$.

$$(-1)^n \cdot e^{-\pi i (n-n_p)/M} \tag{113}$$

This function can be furthered developed and leads to the final expression:

$$x_p(n) = \frac{\sin \pi n_p}{M} \cdot \left[\frac{1}{\tan\left[\frac{\pi(n_p - n)}{M}\right]} + i\right] \tag{114}$$

If $t_p$ is a multiple of the sampling period T, $n_p$ is an integer value, this function is a simple delay:

$$x_p(n_p)=1, \text{ with } n_p \epsilon \mathrm{N} \tag{115}$$

Otherwise $x_p(n)$ is lower than 1 and bounded by the minimum side values around $n_p$:

$$\frac{1}{M \cdot \tan\frac{\pi}{2M}} \text{ with } \lim_{M\to\infty} \frac{1}{M \cdot \tan\frac{\pi}{2M}} = \frac{2}{\pi} \tag{116}$$

Figure 7:
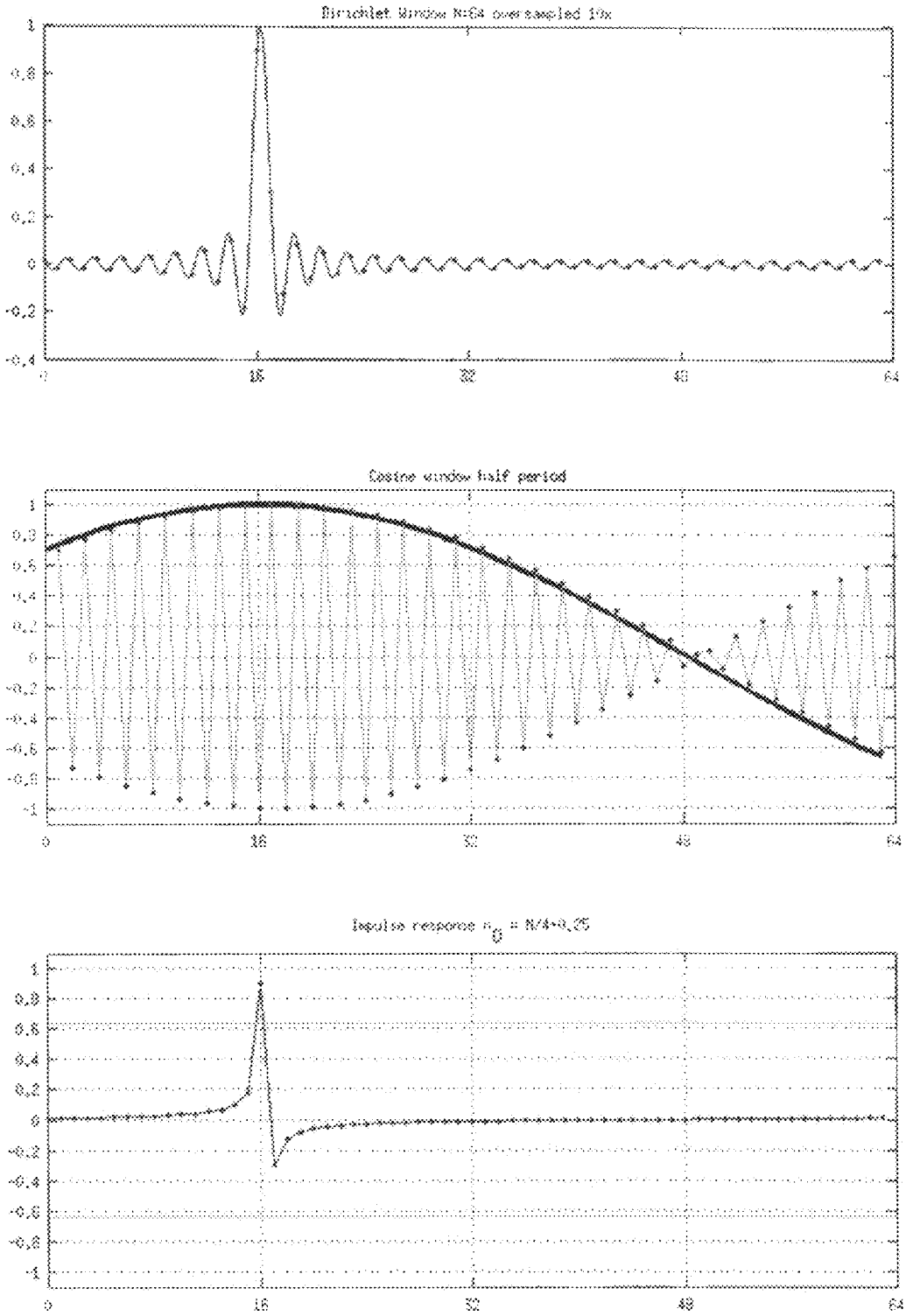
FIG. 7 illustrates the different computational steps resulting to the final impulse response for M=64 and a non-integer delay corresponding to (M/4+0.25)·T.

FIG. 7 illustrates the different computational steps resulting to the final impulse response for M=64 and a non-integer delay corresponding to (M/4+0.25)·T. The points are the real values of the digital filter.

Simplification in the Case of Integer Value of the Delay

When considering the simple delay case, a discretization of the acoustic space occurs. The error corresponding to this discretization is bounded by the air propagation distance in the time interval of half of the sampling period. For example, in the usual case of a sampling frequency of 48 kHz, the delay is T/2 and the distance: c·T/2=343.2/96000 #3.6 mm. This approximation is considered as sufficient for the cases we are interested in. A digital filter for the simulation of the monopole transfer function is consequently:

$$s_p(n) = \frac{\rho}{t_p}\delta(n-n_p) = \frac{\rho c}{R_{p0}}\delta(n-n_p), \text{ where} \tag{117}$$

$$\delta(n-n_p) = \begin{cases} 1, & n = n_p \\ 0, & n \neq n_p \end{cases}$$

In this simplest form, the synthesis is thus performed in the form of delayed and amplified components of the target source signal x.

The delay $n_p$ for a synthesis monopole indexed p is corresponding to the propagation time of sound for the Euclidean distance $r=R_{p0}=|r_p-r_o|$ between the target monopole $r_o$ and the generator $r_p$. The amplification factor $$a_p = \frac{\rho c}{R_{p0}}$$

is inversely proportional to the distance $r=R_{p0}$.

Solution for the Small Distance Problem

The previous equation has the drawback to be growing inversely proportional to the distance $r=R_{p0}$ and to be consequently infinite for $R_{p0}=0$. This case occurs, where the target monopole would be placed exactly at the position of one of the monopoles used for the synthesis. To circumvent this problem, we introduce a modification of this original gain factor. Instead of choosing a direct inverse proportionality to the distance r we decide to replace it by a function, which converges to 1 for r and fulfill the inverse proportionality for larger value of r. This is satisfied, for example, by the function:

$$\frac{1}{\sqrt{1+r^2}} \tag{118}$$

Figure 8:
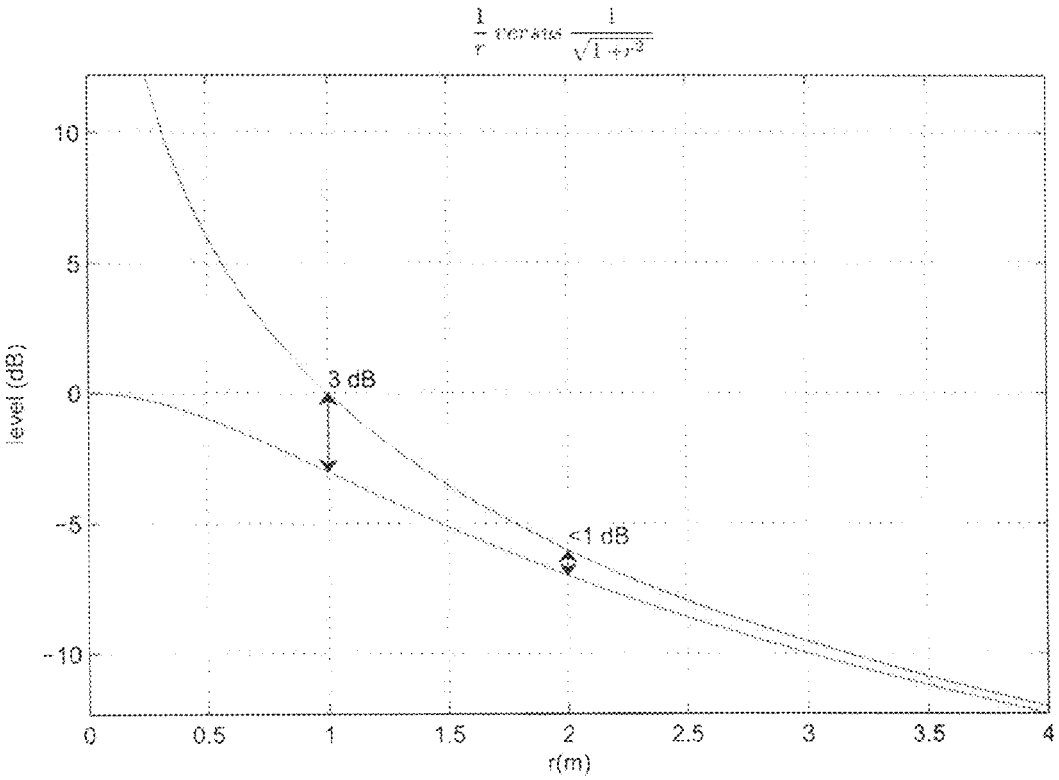
FIG. 8 illustrates how the gain factor decreases as function of distance r.

FIG. 8 illustrates the corresponding curves for a distance up to 4 m.

Of course, this function can be replaced by other candidates, which satisfy the condition to not diverge at a zero distance.

Addition of Mapping Factor

Figure 9:
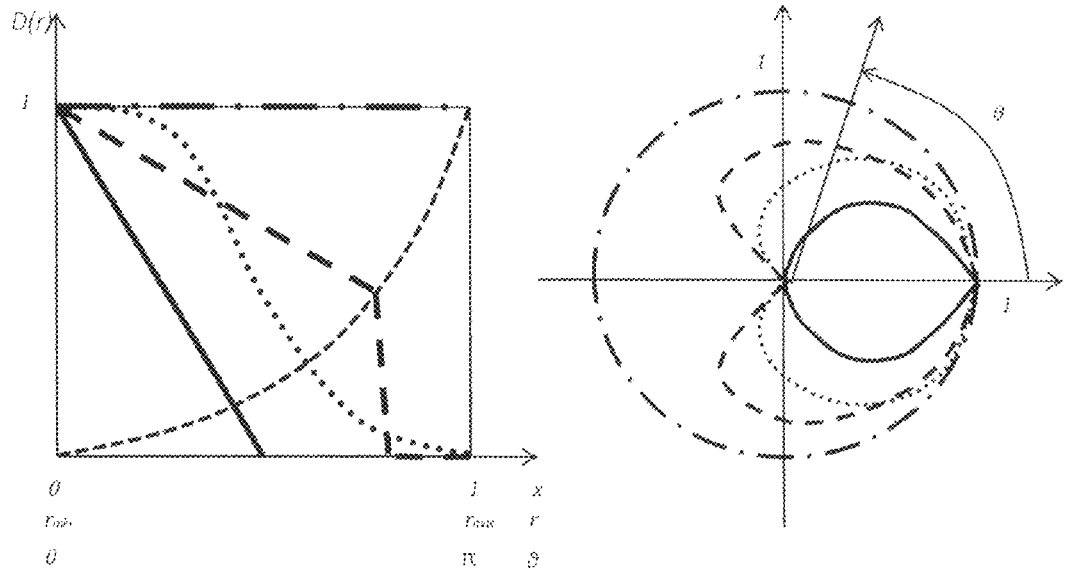
FIG. 9 illustrates different embodiments of mapping functions.

In some cases, we would like to include some variation in the spreading of the simulated source. The source should be perceived as very punctual instead of enveloping. For this purpose, a mapping factor can be included in the previous equation, by modifying the previous gain factor. As a possible solution, we propose a mapping factor D(r), varying in the range of values [0 . . . 1], which is a function of the distance r. This is illustrated in FIG. 9.

For a set of N monopoles, we compute the minimum $r_{min}$ and maximum distance $r_{max}$. This function is mapped to the range of values x=[0 . . . 1], for example by using a linear mapping function:

$$x = \frac{r - r_{min}}{r_{max} - r_{min}} \tag{119}$$

The mapping factor D(r) is then a (semi-)continuous function of x, which maps every distance (and corresponding gain factor) to the range [0 . . . 1]. The curves plotted in FIG. 9 show different possible mapping functions. The right side shows the corresponding mapping if we map the range x=[0 . . . 1] to the angle range θ=[0 . . . π]. The dashed-dotted function corresponds to an omnidirectional mapping, the cosine like function in dotted line corresponds to a cardioid.

FIG. 9 illustrates different embodiments of mapping functions. The left plot depicts the mapping functions D(r) in a Cartesian coordinate system as a dependency from r, x or θ. The right plot depicts the same mapping functions D(r) in a polar plot.

System for Digitalized Monopole Synthesis in the Case of Integer Delays

Figure 10:
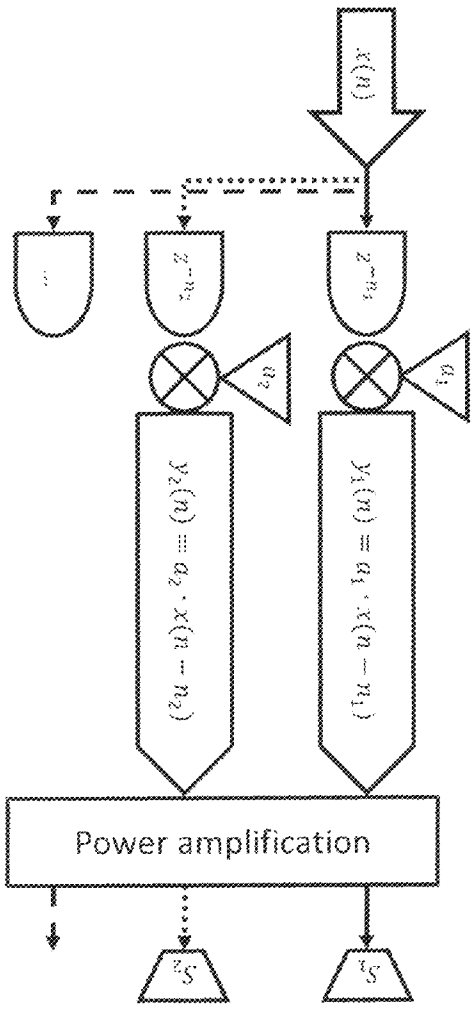
FIG. 10 provides a schematic diagram of a system applying the digitalized Monopole Synthesis algorithm in the case of integer delays.

FIG. 10 provides an embodiment of a system which implements a method that is based on a digitalized Monopole Synthesis algorithm in the case of integer delays.

A source signal x(n) is fed to delay units labelled by $z^{-n_p}$ and to amplification units $a_p$, where p=1, N is the index of the respective synthesis monopole used for synthesizing the target monopole signal. The delay and amplification units according to this embodiment may apply equation (117) to compute the resulting signals $y_p(n)=s_p(n)$ which are used to synthesize the target monopole signal. The resulting signals $s_p(n)$ are power amplified and fed to loudspeaker $S_p$. In this embodiment, the synthesis is thus performed in the form of delayed and amplified components of the source signal x.

According to this embodiment, the delay $n_p$ for a synthesis monopole indexed p is corresponding to the propagation time of sound for the Euclidean distance $r=R_{p0}=|r_p-r_o|$ between the target monopole $r_o$ and the generator $r_p$.

Further, according to this embodiment, the amplification factor $$a_p = \frac{\rho c}{R_{p0}}$$

is inversely proportional to the distance $r=R_{p0}$.

In alternative embodiments of the system, the modified amplification factor according to equation (118) can be used.

In yet alternative embodiments of the system, a mapping factor as described with regard to FIG. 9 can be used to modify the amplification.

Mirror Image Source Concept

The embodiments described below provide the integration of different acoustic actuators in a single device, which take into account the room reflections for the generation of an enlarged sound field. The use of multiple of such devices, placed at a reduced set of locations, can allow the user the submersion in an enlarged sound field experience. In particular, ceiling reflections may allow the extension of the sound field in the height dimension. This dimension is an important part of our daily auditory experience, like sound of birds in the tree, airplanes, music in concert rooms, etc.

The embodiments described below may extend the auditory experience of the user, while still using a restricted number of acoustic enclosures. The enclosures according to these embodiments integrate supplementary actuators, which use the reflection properties of an existing room.

In particular embodiments, the height dimension is taken into account by integrating a supplementary actuator in devices already placed on the floor, which use the ceiling reflections of the room.

In room and architectural acoustics, the mirror image source concept has been introduced to understand the complex interaction of sound with a room. This concept is the exact solution of acoustic equations only in the case of a point source placed in front of a perfectly rigid wall of infinite size. But this approximation offers the main advantage to allow an intuitive and fast understanding of the reflection patterns, which are occurring in a room. A jointly related concept is the ray-tracing method used also in computer graphics. In acoustics, the ray-tracing method considers a sound source as an object, which is emitting rays in all directions and these rays are reflected by the surrounding walls to reach a receiver at some defined position.

Figure 11:
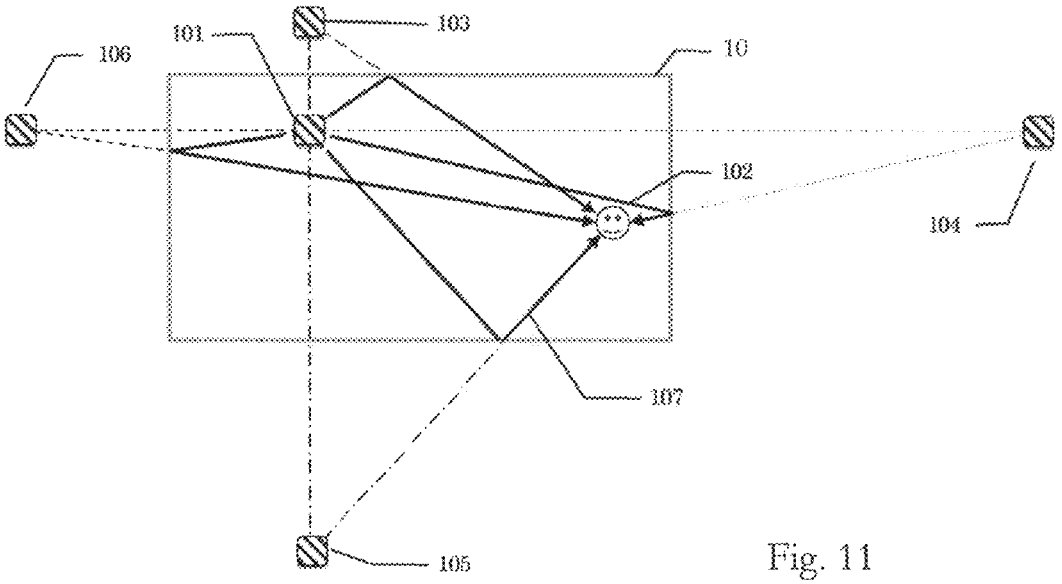
FIG. 11 shows a sound source and mirror images of first order, with an example of rays for a particular receiver.

FIG. 11 shows a sound source and mirror images of first order, with an example of rays for a particular receiver.

It is shown an example of four first order reflections generated by a single omnidirectional sound source 101 on the four walls of a shoebox type of room 100. An example of rays emitted by this source and the corresponding paths to a defined receiver 102 are also depicted. The receiver 102 perceives first the direct sound emitted by the source 101, followed in order of increasing length of paths, by the sound reflections coming from the mirror images 103, 104, 105 and 106. The length l of one of this path, as depicted for example by 107 is the same as the distance from the mirror image source 105 to the receiver 102. The sound delay t in seconds is linearly proportional to the length of this path with a value determined by the velocity of sound transmission in the air c:

$$t = \frac{l}{c}, \text{ with } c = 343.2 \text{ m/s at } 20^\circ \text{ C.} \tag{120}$$

Figure 12:
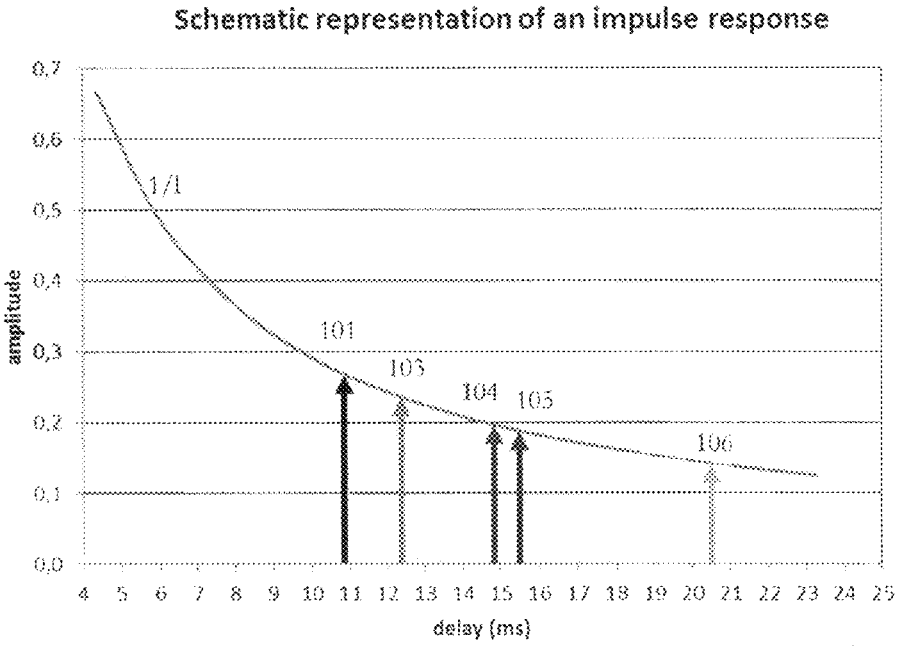
FIG. 12 schematically depicts in a diagram the theoretical impulse response obtained in the case of the mirror image sources distribution of FIG. 11.

The sound amplitude is decreasing inversely proportional to the propagation length l of the reflection, the impulse response in this case would look theoretically like depicted in FIG. 12. The generated sound field is the same, as if every image source would have emitted an impulse at exactly the same time. In real rooms, the situation is much more complicated, since the walls are not infinite, not fully reflective and the sound field also continues to propagate to other walls, which creates higher order reflections. Ultimately, the number of reflections is becoming very large and is named reverberation. In the case, where the room is very large, the delays of the first order reflections can also be very large and creates clearly perceivable echoes. Of course, this principle holds also for ceiling and floor reflections.

FIG. 12 schematically depicts in a diagram the theoretical impulse response obtained in the case of the mirror image sources distribution of the sources 101, 103, 104, 105 and 106 of the arrangement in embodiment described above with reference to FIG. 11. The diagram shows the amplitude of the impulse response over the delay. The amplitude of the impulse response is inversely proportional to the length l of the reflection, respectively the propagation delay.

Use of Mirror Image Source Concept for Virtual Sound Source Generation

Figure 13:
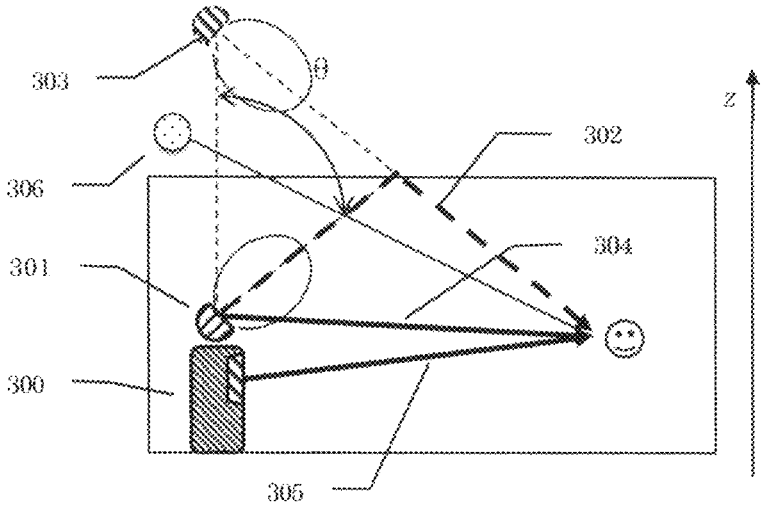
FIG. 13 schematically shows an example of an acoustic setting for the creation of a virtual source in the height (z) dimension.

FIG. 13 schematically shows an example of an acoustic setting for the creation of a virtual source in the height (z) dimension.

The embodiment describes a possible way of generating a mirror sound source from the ceiling, based on the integration of a supplementary actuator in one of the loudspeaker enclosure 300 placed on the floor. It shows the use of an actuator 301 placed in a certain elevation angle. Due to the first order ceiling reflection 302, again assuming a perfectly rigid wall, the sound generated by this actuator is reflected, as if the source would be placed at the symmetrical position in a mirror, and creates a virtual source 303. To create a clearer image, it implies that the actuator 301 should present directivity with a reduced energy for the direct sound path 304. This can be realized by using for example horn loudspeakers or loudspeaker arrays, which have an almost constant directivity for all frequencies of their range within a reduced angle of emission. Using this virtual loudspeaker and combining it with the direct sound 305 generated by the loudspeaker of enclosure 300, it is then possible to generate a phantom source 306, by using e.g. simple amplitude panning, like those used in stereo system or more complicated techniques like Wave Field Synthesis or Monopole Synthesis, which are also taking into account the delay of the phantom source.

Figure 14:
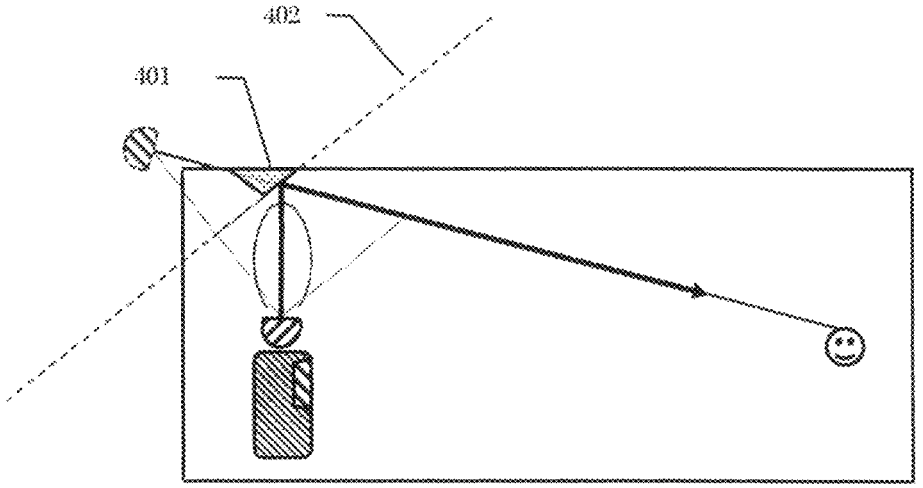
FIG. 14 schematically shows an embodiment comprising the generation of a mirror image source using a passive reflector.

FIG. 14 schematically shows an embodiment comprising the generation of mirror image source using a passive reflector. In this embodiment it is described the same principle as described with reference to the embodiment of FIG. 13, now applied to a passive reflector 401 placed at the ceiling. Here also, the approximation is acoustically crude, since the reflection surface in mirror plane 402 is in this case very small. Only a small frequency band would be reflected in this case and diffractions would occur on the edges, but this concept can still be used to extend the subjective impression in the height.

Figure 15:
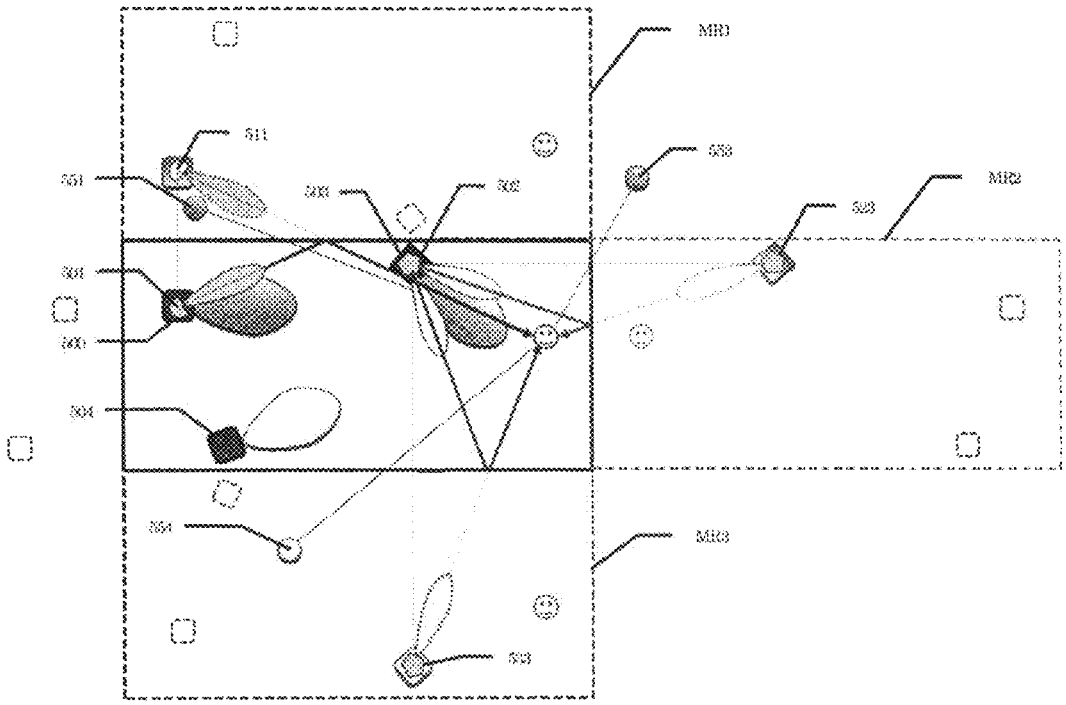
FIG. 15 shows an embodiment of an acoustic setting in the horizontal plane showing the original place of existing loudspeakers and their respective first order mirror images on the wall.

FIG. 15 shows an embodiment of an acoustic setting in the horizontal plane showing the original place of existing loudspeakers and their respective first order mirror images on the wall. This embodiment shows now a more generic description of a set-up with three enclosures placed in the room at locations, which are not symmetrical. Some of the possible first order mirror image sources of the walls, which could be exploited with the principle described previously, are also depicted in the case of a classical rectangular (shoebox) room.

The mirror images of the rooms themselves are labelled by MR1, MR2 and MR3 in this figure. Each of the three enclosures can be of different types and composed of different actuators. The first enclosure depicted here is composed of a standard box 500, which can include one or more loudspeakers depending on the expected sound quality and frequency range. It contains also a separate actuator 501, which is dedicated to the use of a room reflection from MR1. The second enclosure is also composed of a standard box, 502, which could also be of the same type as 500 and contains also a separate actuator 503, which is able to generate configurable directivity characteristics. In this schematic representation, 503 is depicted as a pentagon. The third enclosure 504 can also be of similar type as 500 and in this case doesn't include any extra actuator. Three phantom sources labelled 551, 553 and 554 are depicted. 551 is generated here by using the reflection 511 from the actuator 501 coming from MR1. In this case, this phantom source could be generated by using for example only one enclosure composed of 500 and 501. 553 can be also generated in a similar way as 551 using the combination of 502 and the reflection from MR2 generated by the actuator 503. Finally, 554 is generated in this case by using a combination of the enclosure 504 and of the wall reflection from MR3 generated by the actuator 503.

Many different combinations are conceivable by using different actuators or a combination of them.

In yet other embodiments, to generate the final sound field, each virtual loudspeaker is considered as a real one from the renderer point of view (VAB, Wavefield Synthesis, Monopole Synthesis, etc.) and used correspondingly. In particular, according to an embodiment, a virtual loudspeaker is described as a monopole source according to the methods described above and used in a monopole synthesis as described in this disclosure to generate the target sound field. In particular, the methods, devices and systems of monopole synthesis as described with regard to FIGS. 1 to 10 may be used to generate the target sound field using i.a. a virtual loudspeaker as described here.

Room reflections as described above can be used for the creation of virtual sound sources by integrating supplementary actuators in classical loudspeakers enclosure.

The actuators may be selected in a way to generate a very directive radiation, which is not conflicting with the direct sound of the main enclosures and is emitting in a different direction.

Directive actuators used may be of the horn loudspeakers type. In other embodiments, the directive actuators are generated by loudspeaker arrays.

Also, the actuators may generate multiple directivity characteristics.

The choice of the reflection to be used may be depending on the application and spatial effect to be generated.

In particular, the embodiments described above may take into account also the ceiling reflections to extend the spatial audio impression in the height direction.

Spatial Sound Field Simulation Using a Combination of a Multi-Channel Decorrelation System and a Virtual Sound Generation System Based on a Ceiling Reflection.

In the following it is described a virtual sound system that uses a combination of a multi-channel decorrelation system and a virtual sound generation system based on a ceiling reflection.

The goal of a virtual sound system as described below is to offer the listener the impression of an enveloping sound system, as it exists in classical multi-channels surround system (e.g. 5.1, 7.1, etc. . . . ), but with a very limited set of loudspeakers (stereo) often placed closely to or included in a TV set.

The virtual sound system creates the surround impression by simulating the real surround system, and is composed of the same limited number of virtual loudspeakers.

The virtual surround system as described in the embodiments below is extended with the height dimension by adding a sound generation system, which uses also acoustic ceiling reflections as they were described in the embodiments above. The effect of the virtual surround system of this embodiment is thus not limited to the horizontal plane, despite that the virtual surround system may use only a front stereo loudspeaker configuration.

In the embodiments described below, the simulation of the real surround system is performed by using a set of so-called HRTF (Head Related Transfer Functions), which represent the (binaural) transfer function from a particular sound source direction to the ears of a listener.

Figure 16:
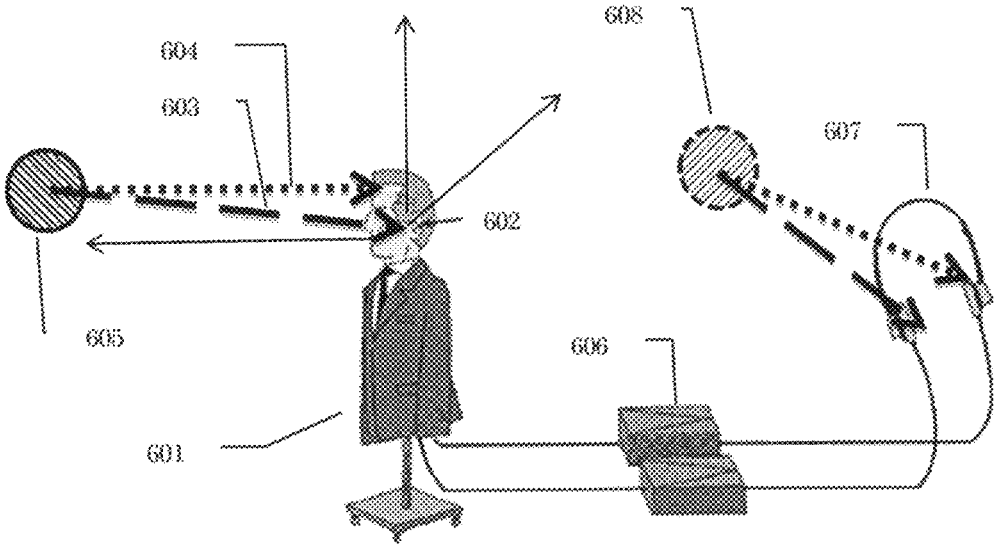
FIG. 16 schematically shows the general principle of a binaural system, in combination with headphone rendering.

FIG. 16 schematically shows the general principle of a binaural system, in combination with headphone rendering. In order to record sound, a dummy-head 601 is carrying microphones 602 arranged at each ear of the dummy-head 601. The microphone 602 receives a left HRTF sound signal 603 and a right HRTF sound signal 604 emerging from a real sound source 605.

The signals received by microphones 602 are amplified with amplifiers 606 and played back via headphone 607. This generates, for the person who carries headphone 607, a perceived virtual sound source 608.

In the case of the virtual surround system as described here, the sound sources are the loudspeakers to be simulated, placed at the positions where the ideal real set-up would be done.

To use the binaural principle in combination with a real or virtual stereo loudspeaker set-up, in the embodiments described below the acoustic interferences (called cross-talk), which occur on contralateral channels (right hear perceives both left and right loudspeakers and vice-versa) may be suppressed. This may be done with so-called cross-talk cancellation systems, which goal is to decorrelate the left and right channels, ideally the same way as if the listener would wear a headphone.

Figure 17:
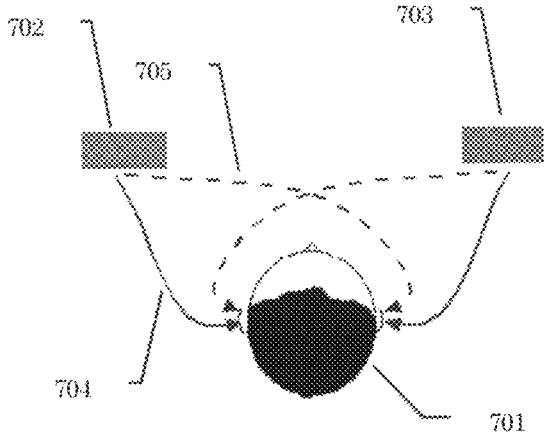
FIG. 17 schematically shows the cross-talk effect.

FIG. 17 schematically shows the cross-talk effect. A person 701 is located in front of a loudspeaker pair consisting of a left speaker 702 and a right speaker 703. The primary signal 704 (bold line) of left speaker 702 reaches the left ear of person 701. An unwanted cross-talk signal 705 (dashed line) emerging from left speaker 702 reaches the right ear of person 701. The same happens with respect to the sound signal emerging from the right speaker.

Figure 18:
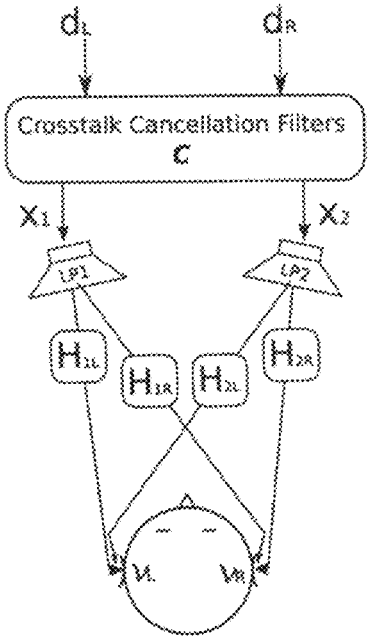
FIG. 18 schematically shows the cross-talk cancellation principle.

FIG. 18 schematically shows the cross-talk cancellation principle. Cross talk compensation filters C receive a left input signal $d_L$ and a right input signal $d_R$. The cross-talk compensation filters C perform a cross-talk compensation on left input signal $d_L$ and right input signal $d_R$ to obtain cross-talk compensated signals $x_1$ and $x_2$. The cross-talk compensated signals $x_1$ and $x_2$ are fed to two loudspeakers LP1 and LP2. A person who is positioned before loudspeakers LP1 and LP2 receives at his left ear a sound signal H1L which emerges from the first loudspeaker LP1 and a sound signal H2L which emerges from the second loudspeaker LP2. The person receives at his right ear a sound signal H1R which emerges from the first loudspeaker LP1 and a sound signal H2R which emerges from the second loudspeaker LP2.

The virtual sound system of this embodiment addresses the location confusion problems by adding supplementary acoustic information in particular for the front height dimension. The height dimension is addressed by adding a sound generation system, which uses also the ceiling reflection in the room. The principle of sound generation which uses ceiling reflection has already been addressed in more detail in the embodiments described above.

According to alternative embodiments, this ceiling reflection principle may be used in conjunction with the combination of cross-talk cancellation and the virtual surround system to generate a sound field which encompass both the horizontal and a front vertical area.

Figure 19:
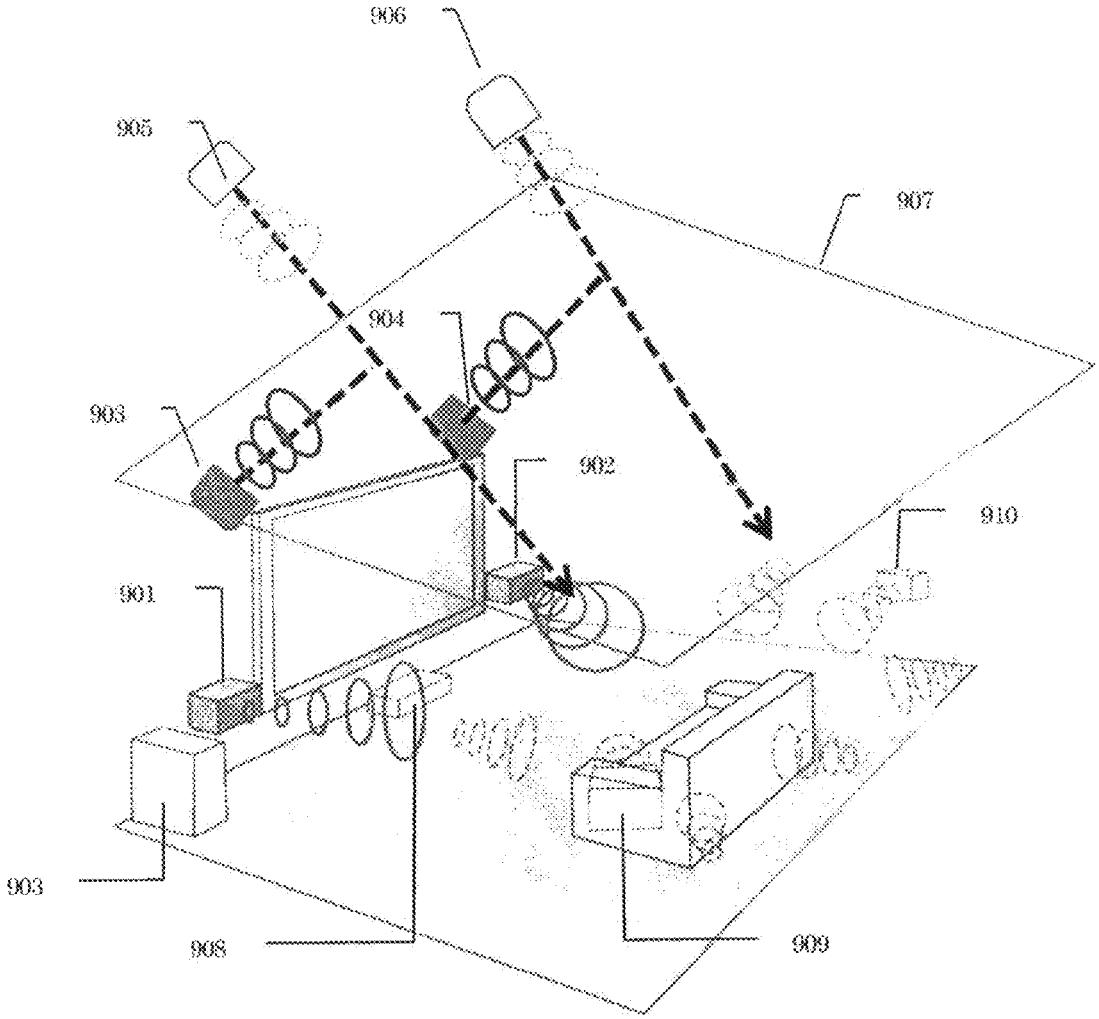
FIG. 19 schematically describes a global acoustic set-up description which uses front sound field generation by means of a left front speaker, a right front speaker and a subwoofer.

FIG. 19 provides an embodiment of a global acoustic set-up description which uses front sound field generation by means of a left front speaker 901, a right front speaker 902 and a subwoofer 903. A left front ceiling speaker 903, by reflections on ceiling 907, provides a virtual left front ceiling speaker 905. A right front ceiling speaker 904, by reflections on ceiling 907, provides a virtual right front ceiling speaker 906. Further, the set-up provides a virtual centre speaker 908, a virtual left surround speaker 909, and a virtual right surround speaker 910.

In other embodiments, the front sound field generation can be extended if necessary by adding loudspeakers at other places in the room, as it was described with respect to the embodiment of FIG. 15 above. Still further, passive reflectors such as described in the embodiment of FIG. 14 may be applied.

In the embodiments, to generate the target sound field, each virtual loudspeaker may be considered as a real one from the renderer point of view (VAB, Wavefield Synthesis, Monopole Synthesis, etc.) and used correspondingly. In particular, according to an embodiment, a virtual loudspeaker is described as a monopole source according to the methods described above and used in a monopole synthesis as described in this disclosure to generate the target sound field. In particular, the methods, devices and systems of monopole synthesis as described with regard to FIGS. 1 to 10 may be used to generate the target sound field using i.a. a virtual loudspeaker as described here.

Figure 20:
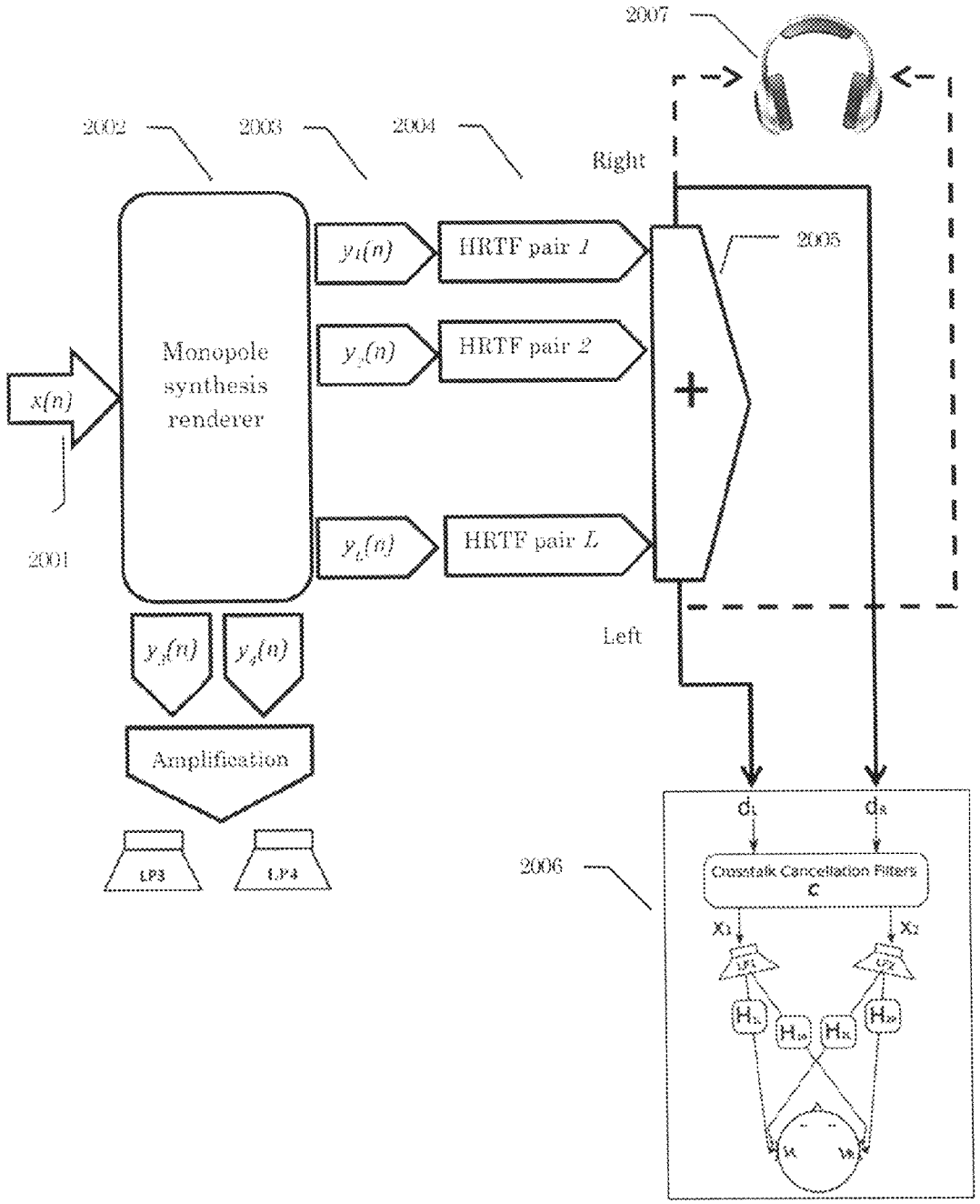
FIG. 20 provides a schematic diagram of the signal processing modules for the realization of the sound field generation described in FIG. 19.

FIG. 20 provides a system diagram embodiment for the global acoustic set-up described in FIG. 19. The input signal x(n) in 2001 used for playback on a target monopole sound field is sent to the Monopole Synthesis renderer 2002 as already depicted in FIG. 10. The generated L outputs $y_p(n)$ in 2003 are sent to a virtual loudspeaker system 2004 composed of a set of HRTF pairs (one for each virtual loudspeaker). These outputs are then mixed together 2005 and the generated outputs for the left and right channel sent respectively to the inputs $d_L$ and $d_R$ of a cross-talk cancelling system as illustrated in FIG. 18 or to a standard headphone 2007 for a binaural playback. LP1 and LP2 could be mapped respectively to 901 and 902 in FIG. 19. Alternatively, for example, two of these outputs like $y_3(n)$ and $y_4(n)$ could be sent to the virtual loudspeakers 905 and 906 by using after amplification the real enclosures 903 and 904.

It should be recognized that the embodiments describe methods with an exemplary ordering of method steps. The specific ordering of method steps is however given for illustrative purposes only and should not be construed as binding. For example the contributions of the synthesis monopoles may be calculated in any arbitrary order.

Likewise, the division of units in the embodiments is only made for illustration purposes. The present disclosure is not limited to any specific division of functions in specific units. For instance, the processor for determining the synthesis contributions, and/or the processor for determining HRTF functions and or the cross-talk cancellation filter may be implemented by separate devices or by a single device, e.g. a processor.

The methods can be implemented as a computer program causing a computer and/or a processor, to perform the method, when being carried out on the computer and/or processor. In some embodiments, also a non-transitory computer-readable recording medium is provided that stores therein a computer program product, which, when executed by a processor, such as the processor described above, causes the method described to be performed.

All units and entities described in this specification and claimed in the appended claims can, if not stated otherwise, be implemented as integrated circuit logic, for example on a chip, and functionality provided by such units and entities can, if not stated otherwise, be implemented by software.

In so far as the embodiments of the disclosure described above are implemented, at least in part, using software-controlled data processing apparatus, it will be appreciated that a computer program providing such software control and a transmission, storage or other medium by which such a computer program is provided are envisaged as aspects of the present disclosure.

Note that the present technology can also be configured as described below.

(1) A Method for approximating the synthesis of a target sound field based on contributions of a predefined number of synthesis monopoles placed at respective synthesis positions, the method comprising modelling the target sound field as at least one target monopole placed at a defined target position.

(2) The method of (1) in which the contribution of a synthesis monopole is dependent on the relative distance between the synthesis monopole and the target monopole.

(3) The method of (1) or (2) in which the contribution of a synthesis monopole is determined based on equation $$S_p(\omega) = i\rho c \frac{\sin kR_{p0}}{R_{p0}}$$

where $S_p(\omega)$ is the pressure transfer function of synthesis monopole indexed p in terms of angular velocity ω, k is the wave number corresponding to angular frequency ω, $R_{p0}=|r_o-r_p|$ is the distance between the target monopole at target position $r_o$ and the synthesis monopole indexed p at position $r_p$, ρ represents a mean density of air, and c represents the celerity of sound in air.

(4) The method of anyone of (1) to (3) in which after discretization the contribution $s_p(n)$ of a synthesis monopole indexed p is determined according to equation $$s_p(n) = \frac{\rho c}{R_{p0}} \cdot \frac{\sin \pi n_p}{M} \cdot \left[ \frac{1}{\tan\left[\frac{\pi(n_p - n)}{M}\right]} + i \right]$$

where T is the sampling period, $n_p=t_p/T$, $R_{p0}=|r_o-r_p|$ is the distance between the target monopole at target position $r_o$ and a synthesis monopole indexed p at position $r_p$, $t_p$ is the sound propagation delay for distance $R_{p0}$, M is the number of samples used for the digital filter, n is a sample number, ρ represents a mean density of air, and c represents the celerity of sound in air.

(5) The method of anyone of (1) to (4) in which the contribution of a synthesis monopole is dependent on an amplification factor and a delay.

(6) The method of (5) in which the amplification factor of a synthesis monopole is inverse proportional to the relative distance between the target monopole and the synthesis monopole.

(7) The method of (5) or (6) in which the amplification factor is modified by a mapping factor.

(8) The method of anyone of (5) to (7) in which the amplification factor of a synthesis monopole is chosen to be inversely proportional to the relative distance between the target monopole and the synthesis monopole for larger value of the relative distance, but to converge to one for small values of the relative distance.

(9) The method of anyone of (5) to (8) in which the amplification factor $a_p$ is determined according to equation $$a_p = \frac{1}{\sqrt{1 + r^2}}$$

where $r=R_{p0}=|r_o-r_p|$ is the relative distance between the target monopole at target position $r_o$ and a synthesis monopole indexed p at position $r_p$.

(10) The method of anyone of (5) to (9) in which the delay $n_p$ is determined according to equation $$n_p=t_p/T$$

where T is a sampling period, and $t_p$ is the sound propagation delay for the relative distance $R_{p0}=|r_o-r_p|$ between the target monopole at target position $r_o$ and a synthesis monopole indexed p at position $r_p$.

(11) The method of (5) to (10) in which after discretization, the contribution $s_p(n)$, for each synthesis monopole indexed p, is determined according to equation $$s_p(n)=\rho c\ a_p\delta(n-n_p)=\rho c\ a_p\delta(n-n_p)$$

where $a_p$ is the amplification factor, $n_p$ is the delay, n is a sample number, δ represents Dirac's delta function, ρ represents a mean density of air, and c represents the celerity of sound in air.

(12) The method of anyone of (1) to (11) in which the sound field of the target monopole is approximated according to equation $$p(r \mid r_0, \omega) \approx p_A(r \mid r_0, \omega) = -i\rho c \sum_{p=1}^{N} \frac{\sin(k|r_o - r_p|)}{|r_o - r_p|} \cdot \frac{\exp(ik|r - r_p|)}{4\pi|r - r_p|} \cdot e^{-i\omega t}$$

where $p(r|r_0, \omega)$ is the sound field of the target monopole as function of position r and angular frequency ω, $r_o$ is the position of the target monopole, $p_A(r|r_o, \omega)$ is the harmonic signal resulting from the synthesis, k is the wave number corresponding to angular frequency ω, $r_p$ are the positions of synthesis monopoles, ρ represents a mean density of air, and c represents the celerity of sound in air.

(13) The method of anyone of (1) to (12) in which the target monopole is an ideal monopole source described by equation $$p(r|r_0,\omega)=i\rho\omega g_k(r|r_0)$$

where $p(r|r_0, \omega)$ is the sound field of the target monopole as function of position r and angular frequency ω, $r_o$ is the position of the target monopole, k is the wave number corresponding to angular frequency ω, $g_k(r|r_0)$ is a free space Green's function of the monopole at position $r_n$, and ρ represents the mean density of air.

(14) The method of anyone of (1) to (13) in which at least one of the synthesis monopoles is configured according to a mirror image source concept.

(15) The method of anyone of (1) to (14) in which the approximating the synthesis of a target sound field is done in real-time.

(16) A device comprising a processor configured to receive a target source signal which corresponds to a target monopole placed at a target position, and determine, based on the target source signal, contributions of a predefined number of synthesis monopoles placed at respective synthesis positions, the synthesis monopoles being configured to synthesize the target source signal.

(17) The device of (16) in which the processor is arranged to perform the method of anyone of (1) to (15).

(18) A system comprising the device of (16) or (17) and further comprising a set of loudspeakers, each loudspeaker being associated with a respective synthesis monopole and being configured to render the contribution which is associated with the respective synthesis monopole.

(19) The system of (18) wherein at least one loudspeaker integrates a supplementary actuator in classical loudspeakers enclosure by use of room reflections for the creation of virtual sound sources,

(20) The system of (19) in which the actuator is selected in a way to generate a directive radiation, which is not conflicting with the direct sound of the main enclosures and is emitting in a different direction.

(21) The system of anyone of (19) or (20) in which the at least one loudspeaker comprises a directive actuator that is of the horn loudspeaker type.

(22) The system of anyone of (19) to (21) in which a directive actuator is generated by loudspeaker arrays.

(23) The system of anyone of (19) to (22) in which actuators generate multiple directivity characteristics, each of these directivities being used to create a virtual sound source from a room reflection.

(24) The system of anyone of (18) to (23) further comprising a processing unit which is configured to apply Head Related Transfer Functions to the output signals of the renderer to create, at least one, virtual loudspeaker.

(25) The system of anyone of (18) to (24) further comprising cross-talk cancellation filters configured to generate cross-talk compensated signals from the output signals of the HRTF.

(26) A computer program comprising program code causing a computer to perform the method according to anyone of (1) to (15), when being carried out on a computer.

(27) A non-transitory computer-readable recording medium that stores therein a computer program product, which, when executed by a processor, causes the method according to anyone of (1) to (15) to be performed.

The present application claims priority to European Patent Application 14 179 152.5, filed in the European Patent Office on Jul. 30, 2014, the entire contents of which being incorporated herein by reference.

What is claimed is:

1. A method for approximating a target sound field based on contributions of a predefined number of synthesis monopoles placed at respective synthesis positions, the method comprising:

computing, with circuitry, the contributions of the predefined number of synthesis monopoles, modelling, with the circuitry, the target sound field as at least one target monopole placed at a defined target position based on a least square computation to minimize errors in the contributions of the predefined number of synthesis monopoles;

generating, with the circuitry, an output signal based on the target sound field; and causing at least one loudspeaker to output a sound corresponding to the output signal.

2. The method of claim 1, wherein a contribution of a synthesis monopole is dependent on a relative distance between the synthesis monopole and the at least one target monopole.

3. The method of claim 1, wherein a contribution of a synthesis monopole is determined based on equation $$S_p(\omega) = -i\rho c \frac{\sin kR_{p0}}{R_{p0}}$$

where $S_p(\omega)$ is a pressure transfer function of a synthesis monopole indexed p in terms of angular velocity ω, k is a wave number corresponding to angular frequency ω, $R_{p0}=|r_o-r_p|$ is a distance between the at least one target monopole at target position $r_o$ and the synthesis monopole indexed p at position $r_p$, ρ represents a mean density of air, and c represents a celerity of sound in air.

4. The method of claim 1, wherein after discretization a contribution $s_p(n)$ of a synthesis monopole indexed p is determined according to equation $$s_p(n) = \frac{\rho c}{R_{p0}} \cdot \frac{\sin \pi n_p}{M} \cdot \left[ \frac{1}{\tan\left[\frac{\pi(n_p - n)}{M}\right]} + i \right]$$

where T is a sampling period, $n_p=t_p/T$, $R_{p0}=|r_o-r_p|$ is a distance between the at least one target monopole at target position $r_o$ and a synthesis monopole indexed p at position $r_p$, $t_P$ is a sound propagation delay for distance $R_{p0}$, M is a number of samples used for a digital filter, n is a sample number, p represents a mean density of air, and c represents a celerity of sound in air.

5. The method of claim 1, wherein a contribution of a synthesis monopole is dependent on an amplification factor and a delay.

6. The method of claim 5, wherein in which the amplification factor of a synthesis monopole is inversely proportional to a relative distance between the at least one target monopole and the synthesis monopole.

7. The method of claim 5, wherein the amplification factor is modified by a mapping factor that maps distance and corresponding gain to a range between zero and one.

8. The method of claim 5, wherein the amplification factor is chosen to be inversely proportional to a relative distance between the at least one target monopole and the synthesis monopole for a larger value of the relative distance, and to converge to one for small values of the relative distance.

9. The method of claim 5, wherein the amplification factor $a_p$ is determined according to equation $$a_p = \frac{1}{\sqrt{1+r^2}}$$

where $r=R_{p0}=|r_o-r_p|$ is a relative distance between the at least one target monopole at target position $r_o$ and a synthesis monopole indexed p at position $r_p$.

10. The method of claim 5, wherein the delay $n_p$ is determined according to equation $$n_p=t_p/T$$

where T is a sampling period, and $t_p$ is sound propagation delay for a relative distance $R_{p0}=|r_o-r_p|$ between the at least one target monopole at target position $r_o$ and a synthesis monopole indexed p at position $r_p$.

11. The method of claim 5, wherein after discretization, the contribution $s_p(n)$, for each synthesis monopole indexed p, is determined according to equation $$s_p(n)=\rho c\ a_p\delta(n-n_p)=\rho c\ a_p\delta(n-n_p)$$

where $a_p$ is the amplification factor, $n_p$ is the delay, n is a sample number, δ represents Dirac's delta function, ρ represents a mean density of air, and c represents a celerity of sound in air.

12. The method of claim 1, wherein a sound field of the at least one target monopole is approximated according to equation $$p(r \mid r_0, \omega) \approx p_A(r \mid r_0, \omega) = -i\rho c \sum_{p=1}^{N} \frac{\sin(k|r_o - r_p|)}{|r_o - r_p|} \cdot \frac{\exp(ik|r - r_p|)}{4\pi|r - r_p|} \cdot e^{-i\omega t}$$

where $p(r|r_0,\omega)$ is the sound field of the target monopole as function of position r and angular frequency ω, $r_o$ is a position of the target monopole, $p_A(r|r_0,\omega)$ is a harmonic signal resulting from the synthesis, k is a wave number corresponding to angular frequency ω, $r_p$ are positions of synthesis monopoles, p represents a mean density of air, and c represents a celerity of sound in air.

13. The method of claim 1, wherein the at least one target monopole is an ideal monopole source described by equation $$p(r|r_0,\omega)=i\rho\omega g_k(r|r_0)$$

where $p(r|r_0,\omega)$ is a sound field of the target monopole as function of position r and angular frequency ω, $r_o$ is a position of the target monopole, k is a wave number corresponding to angular frequency ω, $g_k(r|r_o)$ is a free space Green's function of the monopole at position $r_n$, and ρ represents a mean density of air.

14. The method of claim 1, wherein at least one of the synthesis monopoles is configured according to a mirror image source concept.

15. The method of claim 1, wherein the approximating of the synthesis of a target sound field is done in real-time.

16. A device comprising:

a processor configured to compute a contribution of a predefined number of synthesis monopoles, model a target sound field as at least one target monopole placed at a target position based on a least square computation to minimize errors in the contributions of the predefined number of synthesis monopoles, generate an output signal based on the target sound field, and cause at least one loudspeaker to output a sound corresponding to the output signal.

17. A system comprising the device of claim 16 and further comprising a set of loudspeakers, each loudspeaker being associated with a respective synthesis monopole and being configured to render a contribution which is associated with the respective synthesis monopole based on the output signal.

18. The system of claim 17, wherein at least one loudspeaker integrates a supplementary actuator in a classical loudspeaker enclosure by use of room reflections for the creation of virtual sound sources.

19. The system of claim 18, wherein the actuator is selected to generate a directive radiation, which does not conflict with a direct sound of the classical loudspeaker enclosure and is emitted in a different direction, the at least one loudspeaker comprises a horn loudspeaker as a directive actuator, a directive actuator is generated by loudspeaker arrays, and actuators generate multiple directivity characteristics, each of the directivity characteristics being used to create a virtual sound source from a room reflection.

20. The system of claim 17 further comprising:

a processor configured to apply Head Related Transfer Functions (HRTF) to signals to the loudspeakers to create, at least one, virtual loudspeaker, and cross-talk cancellation filters configured to generate cross-talk compensated signals from output signals of the HRTF.

* * * * *